US006575992B1

(12) United States Patent
Takakura

(10) Patent No.: US 6,575,992 B1
(45) Date of Patent: Jun. 10, 2003

(54) SAFE NEEDLE, PLACEBO NEEDLE, AND NEEDLE SET FOR DOUBLE-BLINDING

(75) Inventor: Nobuari Takakura, 1-24-2, Kitanokai, Hachioji-shi, Tokyo 192-0913 (JP)

(73) Assignees: Hanada College: Japan School of Acupuncture, Moxibustion and Physiotherapy, Tokyo (JP); Nobuari Takakura, Tokyo (JP)

( * ) Notice: Subject to any disclaimer, the term of this patent is extended or adjusted under 35 U.S.C. 154(b) by 0 days.

(21) Appl. No.: 09/762,142

(22) PCT Filed: May 17, 2000

(86) PCT No.: PCT/JP00/03144

§ 371 (c)(1),
(2), (4) Date: Apr. 25, 2001

(87) PCT Pub. No.: WO00/72798

PCT Pub. Date: Dec. 7, 2000

(30) Foreign Application Priority Data

May 31, 1999 (JP) ..... 11-152878

(51) Int. Cl.[7] ..... A61H 39/08
(52) U.S. Cl. ..... 606/189; 600/567
(58) Field of Search ..... 606/185, 187, 606/189, 204; 600/567; 128/907

(56) References Cited

FOREIGN PATENT DOCUMENTS

| | | | | |
|---|---|---|---|---|
| DE | 29613731 U1 | * | 10/1996 | |
| DE | 29912131 U1 | * | 3/2000 | |
| EP | 1101482 A1 | * | 5/2001 | ..... A61H/39/08 |
| JP | 55-148738 | | 10/1980 | |
| JP | 57128837 | * | 10/1980 | |
| JP | 57-128837 | | 8/1982 | |
| JP | 57-131446 | | 8/1982 | |
| JP | 57-177752 | | 11/1982 | |
| JP | 57177752 | * | 11/1982 | |
| JP | 57-193838 | | 12/1982 | |
| JP | 193031 | * | 6/1989 | |
| JP | 1-93031 | | 6/1989 | |
| JP | 8155006 | * | 6/1996 | |
| JP | 8-155006 | | 6/1996 | |
| JP | 2000334024 A | * | 12/2000 | ..... A61H/39/08 |

OTHER PUBLICATIONS

The Lancet—vol. 352—Aug. 1, 1998: Early Reports: Introducing a placebo needle into acupuncture research by K. Streitberger et al., pp. 364–365.
The Lancet—vol. 352—Sep. 19, 1998: Correspondence, p. 992.

* cited by examiner

*Primary Examiner*—John J. Calvert
*Assistant Examiner*—Shaun R Hurley
(74) *Attorney, Agent, or Firm*—Jordan and Hamburg LLP

(57) ABSTRACT

A safety needle and a placebo needle are provided for a double blind test. The placebo needle comprises a guide tube; a first stuffing in the guide tube to give resistance to a needle body during its passage therethrough; and a second stuffing in the guide tube at a lower position, to give resistance to the needle body during passage through the guide tube to a specified depth. The needle body is movably held by the first stuffing, and has a length sufficiently long to allow its point to stop just on or above the skin surface. A stopper is mounted to a needle handle or to the guide tube, and prevents the needle handle from advancing further.

52 Claims, 9 Drawing Sheets

SAFE NEEDLE, PLACEBO NEEDLE, AND NEEDLE SET FOR DOUBLE-BLINDING

TECHNICAL FIELD

The present invention relates to a needle set which can be profitably used for double-blind test for strictly evaluating the therapeutic effect of acupuncture in which it is masked from both of the subject and the practitioner whether a true needle or a placebo needle is used, how deep the needle is inserted, what is the diameter of the needle, and where the needle is inserted (acupoint or non-acupoint). This invention further relates to a safety needle and placebo needle suitably used as a member of the double-blind needle set. This invention further relates to a safety needle which does not cause any infection in the patient, the practitioner, and the disposer for used needles.

BACKGROUND ART

It is said that the most excellent and practical method among the methods for evaluating the therapeutic effect of acupuncture is a single-blind method in which only the subject is blinded. In the experiment based on the single-blind method, the control group receives placebo stimulation resembling a needle insertion on an acupoint while the experimental group receives stimulation with true needle insertion at the same acupoint; the results from the two groups are compared; and the therapeutic effect is evaluated.

The currently proposed methods for giving placebo stimulation includes the following three:

(1) To place a guide tube instead of a needle on a site of the skin, and tap the top end of the guide tube;

(2) To transform the tip of a needle into impenetrable to the skin, place the transformed tip on a site of the skin, and press the upper end of the needle (see, for example, The Lancet, vol. 352, Aug. 1998, pp. 364–365); and (3) To place an electrode for percutaneous electrical stimulation on a site of the skin.

Methods (1), (2) and (3) are all employed in experiments based on the single-blind method. With methods (1) and (2), it is possible to completely make the subject unaware of whether the stimulation applied is by a true needle inserted or by a placebo needle pressed, as long as the experiment is properly conducted. This was indeed confirmed for method (2) (see, for example, The Lancet, vol. 352, Aug. 1, 1998, pp. 364–365). However, with method (3), it is hardly possible to mask the nature of stimulation from the subject, because the shape of device used for stimulation, sensation the subject felt induced by a stimulation, etc. are clearly different from those of true needle insertion.

However, with all the above methods aimed at giving placebo stimulation, it is impossible to make the practitioner unaware of the nature of stimulation, that is, the methods can not mask the practitioner whether he applied a true needle or a placebo needle. Namely, all the above methods are inadequate to serve as a placebo stimulation to be given to a control group. When the practitioner applies a needle to a subject, the practitioner feels, through his fingers and hands, the needle making a puncture on the skin, penetrating the skin, and advancing deep into the human body, or he is aware of the point at needling before needle application. Thus, it has been thought impossible to mask the nature of stimulation from the practitioner. Under such current situations, the Consensus Development Conference of US National Health Institute (NIH) concludes that, for the evaluation of acupuncture, it can not help adopting single-blind test because in acupuncture study it is possible to mask the nature of stimulation only from the subject (The Lancet, vol. 352, Sep. 19, 1998, p. 992).

However, because, with single-blind test, expectation or zeal of the practitioner during therapy is transmitted to the subject, a demand is manifest for double-blind method which can mask the nature of stimulation from the practitioner as well as from the subject, to scrutinize the effect of acupuncture.

The acupuncture therapy currently widely in use is based on the insertion technique using the guide tube. The therapy based on the insertion technique is executed with a needle and the guide tube separately prepared. The practitioner inserts the needle into a guide tube by one hand, and forms Oshide(the hand by which to hold the guide tube or the needle during the needle insertion or the needle removal) by placing the thumb and the index finger of the other hand being lightly in contact with each other on a site of the skin; and inserts the guide tube contained the needle between the pads of the thumb and the index finger of Oshide and holds the guide tube adjusting a needle insertion angle being preferable; and taps the top end of the needle handle with the pad of the index finger of Sashide(or the hand by which to insert or remove the needle) to open thereby a puncture on the skin(usually, the guide tube used for the insertion therapy has the length shorter by about 3–4 mm than the total length of the needle, and thus the needle is inserted by that difference into the human body by tapping with the pad of the index finger). After the puncture is opened, the guide tube alone is removed to leave the partly sticking needle on the site; the Oshide directly holds the needle body, and inserts it into the human body with the holding needle. When the needle reaches to a desired depth, the Oshide keeps holding the needle body, or leaves the needle to stand there for an arbitrary period (in-situ needle). Then, the Oshide is formed around the needle to extract it from the body. Immediately after removal, the used needle including its needle body and its tip is bare.

As seen above, during the insertion therapy with a guide tube, the guide tube and the needle body are separated. Thus, the Oshide directly contacts with the needle body when the practitioner inserts or removes the needle into or from the body. Accordingly, before insertion, the needle body may be contaminated through contact with the fingers and hands of the practitioner. Because, for removal, the needle uncovered with the guide tube is extracted from the patient's body, the practitioner's fingers and hands may be contaminated with the patient's body fluid through contact with the bare needle body and tip of the needle. The same risk persists even when the practitioner wears gloves during therapy.

The practitioner or the disposer who handles acupuncture needles may damage himself by accidental contact with a used needle with its bare needle body and its tip. Currently, at acupuncturist training schools and clinical centers used needles are disposed into a cylindrical trash case having a bottom diameter of 8 cm and a height of 17 cm. If the case becomes full, used needles are removed by hand and put into a cardboard box for medical waste. During disposal, when the practitioner put away used needles into a trash case, or when disposer transfers used needles from the trash case to a cardboard box, he may damage himself by accident. Indeed, there was reported such a case.

To prevent contamination in acupuncture therapy, a method is proposed in which the practitioner wears finger covers or operation gloves during therapy. However, this method poses a number of problems: wearing covers or gloves is a nuisance to the practitioner, and the practitioner's fingers and hands may contact with the contaminated surfaces of covers and gloves.

A variety of means to prevent infection during therapy, or during disposal of used needles have been proposed.

Recently, covering the needle body with a coat (Japanese Patent Laid-Open No. Sho 57-131446) and covering the lowest end of a needle with a tube sufficiently small to enter through the inner space of a guide tube (Japanese Patent Laid-Open No. Sho 57-177752) are proposed. With these methods, a needle body and a guide tube are separated from each other during therapy, and they are separately disposed of after therapy. Namely, when disposed of, both the needle body and its tip are bare, and thus these methods do not take into account the risk of a third person who may be exposed, after therapy, to contamination by touching such a needle body or a guide tube accidentally.

The first object of this invention is to provide a safety needle and a placebo needle ensuring the introduction of a double-blind method whereby it is possible to make both the practitioner and the subject unaware of whether the needle applied is a true needle or a placebo needle, or whether the insertion point corresponds with an acupoint or not, thereby enabling a strict evaluation of the effect of acupuncture therapy.

Another object of this invention is to provide a safety needle free from the risk of infection, with which infection from the patient to the practitioner, and from the practitioner to a third person, and to provide a safety needle free from the risk of exposure to infection of the disposer who might otherwise contaminate himself by damaging himself by accident with the needle when disposing.

A further object of this invention is to provide a needle set for double-blind test with which it is possible to mask the depth of needle insertion, and the diameter of needle body.

DISCLOSURE OF THE INVENTION

The safety needle of the present invention to achieve the above object, particularly the safety needle of the present invention to be incorporated into a needle set for double-blind test comprises: (1) a guide tube; (2) one or more stuffings holding needle body which are plugged into the guide tube to be fixed at a desired position, to give resistance to a needle body during its passage therethrough, and to hold the needle body; (3) the needle body movably held by the stuffing which has the length longer than that of the guide tube by an amount equal to the insertion depth of the needle body; and (4) a stopper which is mounted to the lower end of a needle handle attached to the top of the needle body, or which is mounted to the top end of the guide tube, and prevents the needle handle from advancing further at the moment when the needle point reach a specified insertion depth; (5) wherein the guide tube is longer than the insertion depth of the needle body.

The placebo needle of the present invention to achieve the above object, or the placebo needle of the present invention to be incorporated into a needle set for double-blind test comprises: (1) a guide tube; (2) one or more first stuffings which are plugged into the guide tube to be fixed at a desired position, to give resistance to a needle body during its passage therethrough, and to hold the needle body; (3) one or more second stuffings which are plugged into lower position of the guide tube and fixed, to give similar sensation to the skin puncture and the tissue penetration during passage of the needle body therethrough to reach a specified depth; (4) the needle body movably held by the first stuffing which has the length sufficiently long to allow its point to stop just on/above the skin surface when the needle body is advanced through the cavity of the guide tube as far as possible; and (5) a stopper which is mounted to the lower end of the handle needle attached to the top of the needle body, or which is mounted to the upper end of the guide tube, and prevents the needle handle from advancing further into the guide tube when the point of the needle body reaches just on/above the skin surface.

Another placebo needle of the present invention comprises: (1) a guide tube; (2) one or more stuffings holding needle body which are plugged into the guide tube to be fixed at a desired position, to give resistance to the needle body during its passage therethrough; (3) the needle body movably held by the stuffing holding needle body which has the length sufficiently long to allow its point to stop just on/above the skin surface when the needle body being advanced through the cavity of the guide tube as far as possible; and (4) a stopper which is mounted to the lower end of a needle handle attached to the top of the needle body, or which is mounted to the top end of the guide tube, and prevents the needle handle from advancing further into the guide tube when the point of the needle body being advanced through the cavity of the guide tube reaches just on/above the skin.

It is possible to combine the safety needle and the placebo needle into a needle set suitably used for double-blind test.

The needle set of this invention for double-blind test incorporating a placebo needle with the second stuffing, is characterized by that, for the safety needle and placebo needle, the guide tubes are the same in length, the portions of the needles bodies protruding from the top end of the guide tubes are the same in length, the needle handles are the same in length, and the distance from the lowest end of the needle body of the safety needle to the skin surface is the same as the distance from the lowest end of the needle body of the placebo needle to the upper surface of the second stuffing; the upper surface of the second stuffing is placed at a level higher than the bottom end of the guide tube by an amount equal to the insertion depth of the safety needle; and the two needles can not be distinguished from their appearances. It is necessary for blinding both the practitioner and the subject regarding whether a real needle or a placebo needle applied to make the safety needle and the placebo needle look so similar that they can not be distinguished from their appearances. For this purpose, the guide tube should be preferably opaque.

The needle set of this invention for double-blind test incorporating a placebo needle with no second stuffing is characterized by that: for the safety needle and placebo needle, the guide tubes are the same in length, the portions of the needles bodies protruding from the top end of the guide tube are the same in length, and the needle handles are the same in length; and the two needles can not be distinguished from their appearances. It is necessary for blinding both the practitioner and the subject regarding whether a real needle or a placebo needle applied to make the safety needle and the placebo needle look so similar that they can not be distinguished from their appearances. The stuffing for placebo needle having a property as described above is preferably made of a material which has resistance to cancel resistance the practitioner would feel when he inserts a needle into the skin, and advances it through the skin. The needle set incorporating such a placebo needle for double-blind test may be suitable for an acupuncturist unaccustomed with the technique as well as for a practitioner without acupuncture license, or may be suitable for in a case where shallow insertion of a safety needle is needed, the patient has a thin and soft skin, or the site applied has a soft subcutaneous tissue.

Another needle set of this invention for double-blind test comprises: (1) a group of safety needles selected according to the specified double-blind test from needles which are different in at least one of the following properties, the material, length, color and shape of the needle handle; the material, total length, the diameter of the needle body; length of the protruding portion of the needle body from the upper end of the guide tube; the distance from the lowest end of the needle body to the skin surface; the insertion depth of the needle body; the material, length, color and shape of the guide tube; and the material, quantity, the number and position of the stuffing, (2) a group of placebo needles selected from needles which are different in at least one of the following properties, the material, length, color and shape of the needle handle; the material, total length, the diameter, length of the protruding portion of the needle body from the upper end of the guide tube; distance from the lowest end of the needle body to the upper surface of the second stuffing; the material, length, color and shape of the guide tube; and the material, quantity, the number and the position of the first stuffing; and the material, the quantity, the number and the position of the second stuffing; and (3) a set for double-blind test consisting of the safety needle group and the placebo needle group.

With the needle set for double-blind test, it is possible to choose arbitrarily appropriate combination for the modality or an appropriate numerical combination of safety and placebo needles from the viewpoint of the above each character according to the specified double-blind test.

The length of the guide tube is defined as the length of the guide tube including the thickness of stopper if the guide tube has a stopper protruding from its top end.

The length of a needle body should be determined by measuring from the lowest end of a stopper to the point, if the needle handle has the stopper at its lowest end, and that stopper protrudes from the lowest end of the needle handle, or if the stopper is placed along the needle body at an arbitrary position lower than the lowest end of the needle handle.

The guide tube of a safety needle or a placebo needle may have an adhesive or sucking pedestal on its bottom end to keep both kind of needle stable on the skin surface, thereby ensuring the fixation of the guide tube on the skin surface.

BRIEF DESCRIPTION OF THE DRAWINGS

FIG. 1(*a*) is a frontal view; FIG. 1(*b*) a top view; and FIG. 1(*c*) a sectional view of the needle cut along line A–A' in FIG. 1(*b*).

FIG. 3(*a*) is a frontal view; FIG. 3(*b*) a top view; and FIG. 3(*c*) a sectional view of the needle cut along line B–B' in FIG. 3(*b*).

FIG. 5(*a*) is a frontal view; FIG. 5(*b*) a top view; and FIG. 5(*c*) a sectional view of the needle cut along line C–C' in FIG. 5(*b*).

FIG. 7(*a*) is a frontal view; FIG. 7(*b*) a top view; and FIG. 7(*c*) a sectional view of the needle cut along line D–D' in FIG. 7(*b*).

FIG. 9(*a*) is a frontal view; FIG. 9(*b*) a top view; and FIG. 9(*c*) a sectional view of the needle cut along line A–A' in FIG. 9(*b*).

FIG. 10(*b*) another needle in which the flange-like stopper is arranged beneath the lowest end of handle; and FIG. 10(*c*) a still further needle in which the stopper wraps around the lowest end of handle; and FIG. 10(*d*) is a still further needle of which the needle handle has the bulged rim at its lowest end to serve as a stopper.

FIG. 12(*a*) is a frontal view; FIG. 12(*b*) a top view; and FIG. 12(*c*) a sectional view of the needle cut along line B–B' in FIG. 12(*b*).

DETAILED DESCRIPTION OF PREFERRED EMBODIMENTS

The best modes for carrying out the present invention will be explained with reference to attached figures.

Safety Needle

Figure 1:
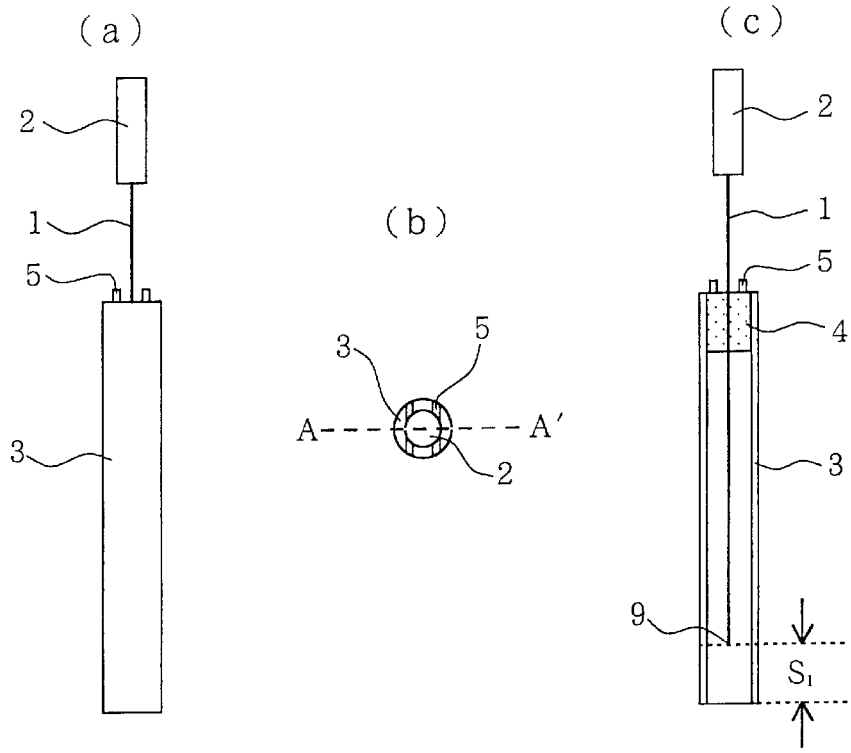
FIG. 1 shows the safety needle of the present invention before use.

FIG. 1 shows the safety needle of the present invention before use: FIG. 1(*a*) is a frontal view; FIG. 1(*b*) a top view; and FIG. 1(*c*) a sectional view of the needle cut along line A–A'.

In this figure, 3 represents a guide tube; and in its upper part of the inner space is plugged and fixed a stuffing holding needle body 4 which gives appropriate resistance to the needle body moving through the stuffing space. Namely, before use, needle body 1 of the safety needle is held stationary by the stuffing holding needle body 4.

The stuffing holding needle body 4 may be plugged and fixed at any desired position in the guide tube 3, but should be preferably plugged and fixed at a certain upper level. The stuffing holding needle body 4 may be made of a laminated body comprising multiple layers composed of different materials. The length of the stuffing holding needle body 4 and its number may be adjusted appropriately according to a given use condition.

Figure 15:
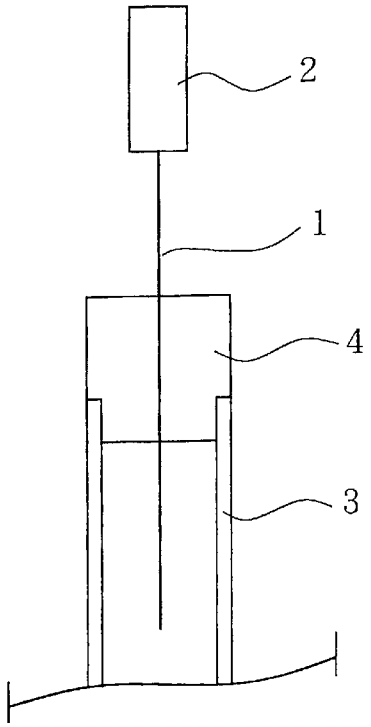
FIG. 15 shows the guide tube of the safety needle which has the stuffing on its top end, the stuffing protruding from the top end of the guide tube and also serving as a stopper. This stuffing is applicable to the placebo needle as well.

The stuffing holding needle body 4 placed on the top end of the guide tube 3 may have its upper surface flush with the top end of the guide tube 3 so that it can also serve as the stopper 5. Alternatively, as shown in FIG. 15, the stuffing holding needle body 4 may have its upper surface protruding from the top end of the guide tube 3. In this case, the protruding portion of the stuffing holding needle body 4 may also serve as the stopper 5. The stuffing holding needle body 4 prevents the entry of the needle handle into the guide tube; and gives resistance during passage of the needle body through the guide tube. The stuffing holding needle body 4 also serving as the stopper will be called a "needle body holding stopper means."

Such a needle body holding stopper means should be preferably shaped like a film, a sheet, a plate, a bulk, a cylinder, etc., and have the diameter sufficiently small to be less than the outer diameter of the guide tube 3.

Further, for example, two kinds of stuffings holding needle body 4 may be placed at the upper and lower portions of the internal cavity of the guide tube 3, and the one placed at the lower portion may be made of alcohol-soaked cotton which serves as the disinfectant of the needle body. Because the safety needle of this invention has its needle body movably held by the stuffing holding needle body 4 placed in the internal cavity of the guide tube, it is possible to straightly move the needle body during needle insertion or needle removal, and thus the guide tube also serves as Oshide.

The stuffing holding needle body 4 may be made of a cotton, a sponge, plastics, a silicone resin, a rubber, a polysaccharide, a protein, a synthetic chemical sponge, a foamed plastics, a synthetic fiber, a natural fiber, a raw meat from livestock/fish, processed meat (ham, etc.) alone or in combination. The stuffing holding needle body 4 movably holds the needle body at its center, and the point 9 of needle body 1 advances to the point apart from the lowest end of the guide tube 3 by a distance S1.

Figure 16:
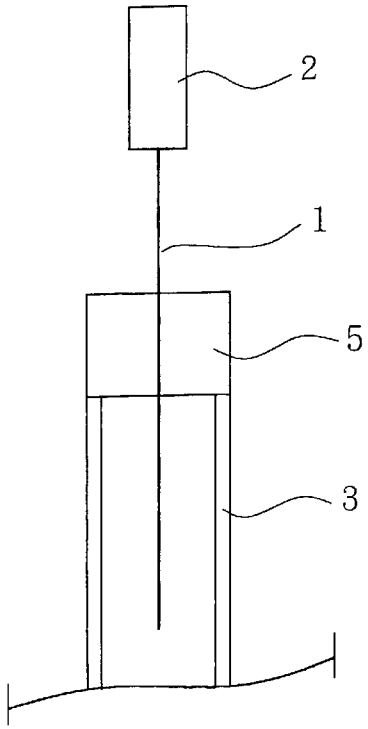
FIG. 16 shows the guide tube of a safety needle, which has the stopper outside, the stopper movably holding the needle body to allow the needle to pass along the central axis, and to give resistance to the needle body approximately the same as that of the stuffing during passage of the needle body through the stuffing, and thus the stopper also serving as the stuffing. This guide tube is also applicable to the placebo needle.

The needle handle 2 is attached to the upper end of the needle body 1. The guide tube 3 has the stopper 5 on its top end to prevent the entry of the lowest end of the needle handle 2 into the guide tube 3. The stopper 5 may be placed outside or inside of the guide tube 3. If the stopper 5 is placed outside the guide tube 3 as shown in FIG. 16, it may movably hold the needle body in such a way as to allow the needle body to pass along the central axis and have a material to give resistance during its passage through the stopper 5, which is approximately the same as the resistance as that by the stuffing holding needle body 4 during the needle body pass through as shown in FIG. 1(*c*), FIG. 2, or FIG. 15. The stopper having such functions as described above will be called a "needle body holding stopper means." Such a needle body holding stopper means should be preferably shaped like a film, a sheet, a plate, a bulk, a cylinder, a clip etc., and have a diameter not longer than the outer diameter of the guide tube 3. The stopper 5 may be placed at the lower end of handle 2, instead of at the side of the guide tube 3.

Figure 9:
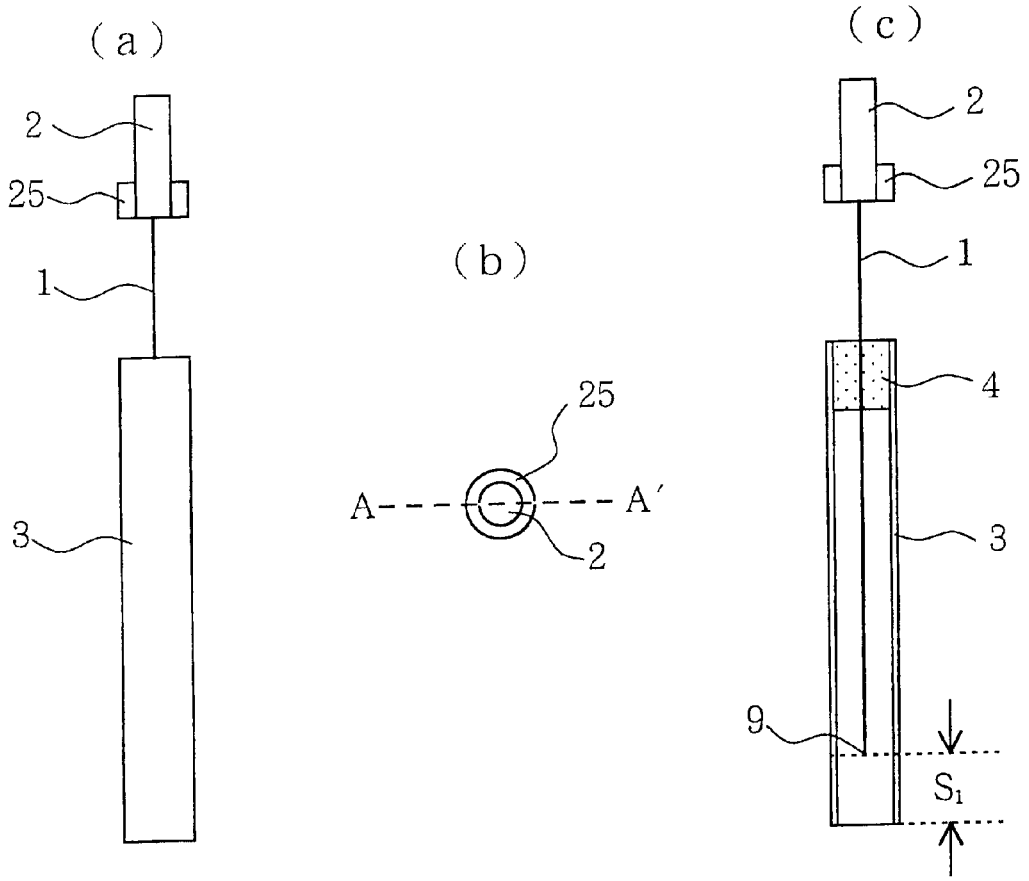
FIG. 9 shows the safety needle of the present invention having the stopper attached to the lowest end of the needle handle.

FIG. 9 shows the safety needle of the present invention having the stopper 25 attached to the lowest end of the needle handle 2: FIG. 9(*a*) is a frontal view; FIG. 9(*b*) a top view; and FIG. 9(*c*) a sectional view of the needle cut along line A–A' in FIG. 9(*b*). The length of the needle body 1 may be appropriately adjusted to give the most therapeutic effect when it is inserted through the guide tube 3 as far as possible.

Figure 10:
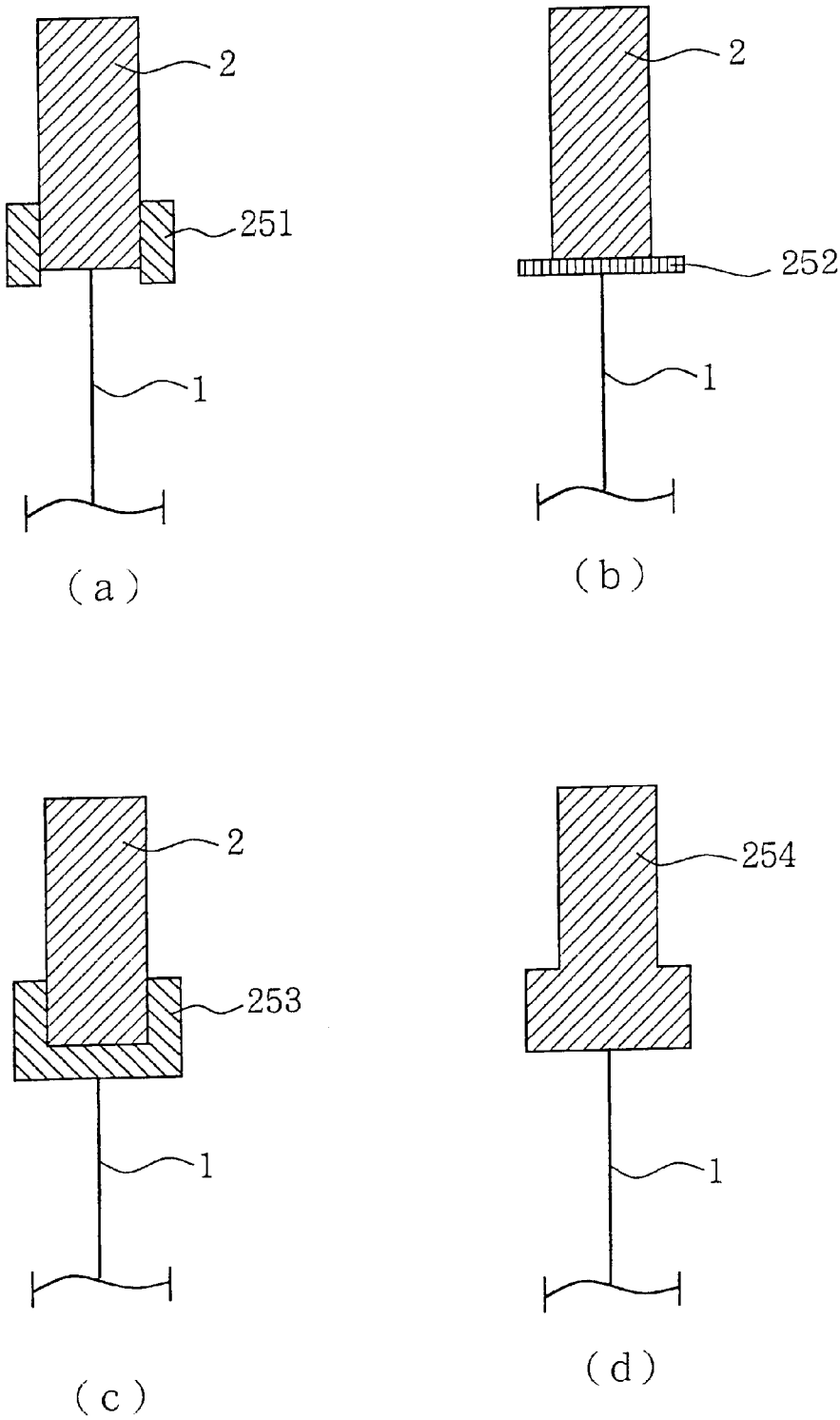
FIG. 10(*a*) shows the needle in which a portion of the stopper protrudes from the lowest end of handle.

FIGS. 10(*a*), (*b*), (*c*) and (*d*) show the stoppers attached to the needle handle 2, and their relation to the needle handle 2 , and represent an embodiment different from the one shown in FIG. 9. FIG. 10(*a*) shows an embodiment of the needle in which a portion of the stopper protrudes from the lowest end of the needle handle 2; FIG. 10(*b*) another embodiment of the needle in which the flange-like stopper is plugged beneath the lowest end of the needle handle 2; and FIG. 10(*c*) a still further embodiment of the needle in which the stopper wraps around the lowest end of the needle handle 2; and FIG. 10(*d*) is a still further embodiment of the needle of which the needle handle 2 has the bulged rim at its lowest end to serve as the stopper.

Figure 11:
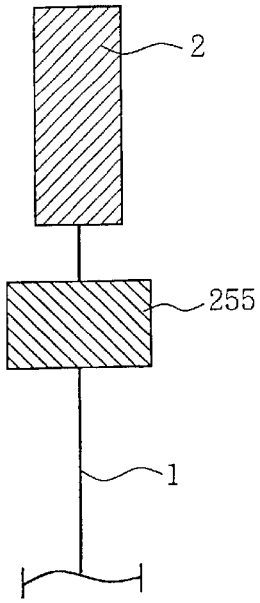
FIG. 11 shows the stopper mounted on the upper portion of the needle body and underneath the needle handle.

FIG. 11 shows an embodiment of the needle which has the stopper 255 on the upper portion of its needle body 1 below the needle handle 2. This stopper 255 may be shaped like a clip.

If the safety needle is exclusively used for therapy, besides double-blind test, the stuffing holding needle body 4 may only movably hold the needle body, and should preferably give smaller resistance during passage of the needle body therethrough than that for double-blind test. Moreover, it is preferable that the guide tube 3 has less diameter and less weight, and the distance S1 is made shorter. A safety needle having such properties as described above is easily inserted by tapping; its guide tube 3 is light; and thus it is easily used as in-situ needle.

Figure 2:
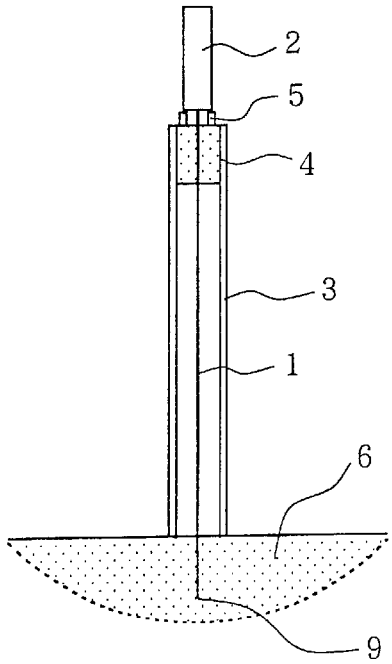
FIG. 2 shows how the safety needle of FIG. 1 is inserted through the skin into the human body.

FIG. 2 shows how the safety needle of FIG. 1 is inserted through the skin into the human body 6. The needle body 1 is so prepared as to make its length equal to the sum of the length of the guide tube 3 and the distance (depth) for needle insertion into the human body 6. The practitioner holds the guide tube 3 with his left hand, and gives a rotatory or thrusting movement onto the needle handle 2 with his right hand.

Thus, he can make the point 9 of the needle body 1 reach a target point in the human body 6 with twirling or simple insertion technique, without directly touching the needle body 1. For removing the needle, the practitioner similarly holds the guide tube 3 with his left hand, and gives a rotatory or simple extracting movement onto the needle handle 2 with his right hand, thereby removing the needle without directly touching the needle body 1. At the time when the safety needle is removed, a larger portion of the needle body 1 including the point 9 remains within the guide tube 3 roughly corresponding with the image shown in FIG. 1. As seen from above, the safety needle of the present invention prevents the practitioner or the disposer for used needle from directly contacting with the needle body 1 and its tip 9, during storage and therapy as well as after removal, and thus it exhibits no risk of infection.

Placebo Needle

Figure 3:
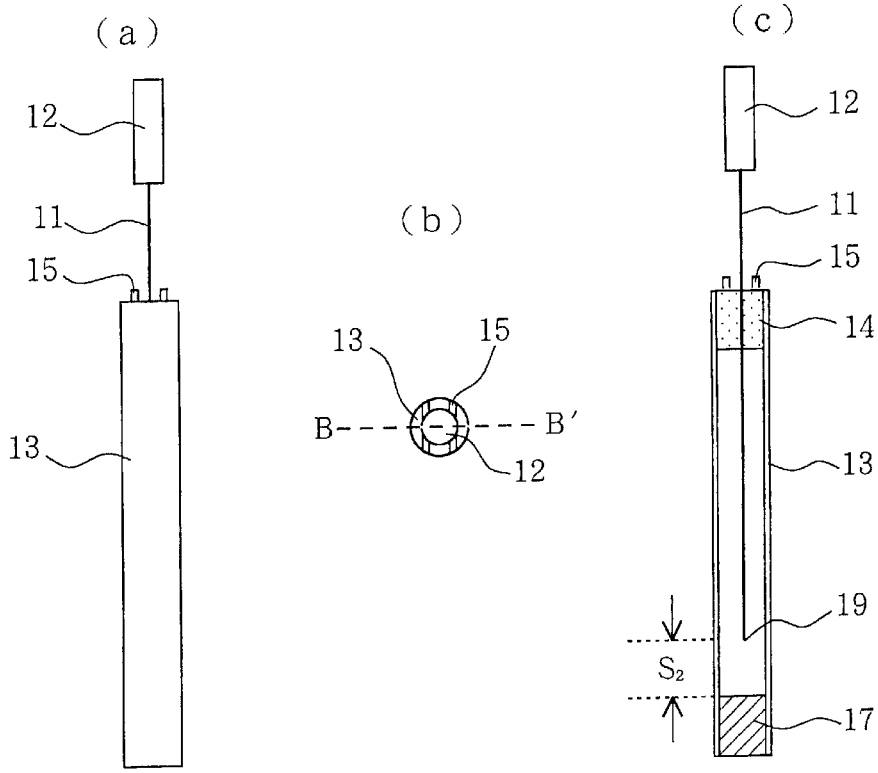
FIG. 3 shows the placebo needle of the present invention before use.

FIG. 3 shows the placebo needle of the present invention before use: FIG. 3(*a*) is a frontal view; FIG. 3(*b*) a top view; and FIG. 3(*c*) a sectional view of the needle cut along line B–B' in FIG. 3(*b*). In this figure, a guide tube 13 is preferably made of a material to make their interior invisible from outside; and in its inner space is plugged and fixed a stuffing holding needle body 14 which gives appropriate resistance to the needle body 14 advancing through the space and holds the needle body 14. The stuffing holding needle body 14 placed on the top end of the guide tube 13 may have its upper surface flush with the top end of the guide tube 13 so that it can also serve as the stopper. Alternatively, the stuffing holding needle body 14 may have its upper surface protruding from the top end of the guide 13. In this case, the protruding portion of the stuffing holding needle body 14 may also serve as the stopper 15. The stuffing holding needle body 14 also serving as the stopper will be called a needle body holding stopper means.

Such a needle body holding stopper means should be preferably shaped like a film, a sheet, a plate, a bulk, a cylinder, etc., and have the diameter not larger than the outer diameter of the guide tube 13. The first stuffing 14 is preferably made of the same material as used for the safety needle. The length of the first stuffing 14 and its number may be adjusted appropriately to usage patterns. The first stuffing 14 may be made of a laminated body comprising multiple layers composed of different materials.

At the lower internal cavity of the guide tube 13, there is plugged and fixed the second stuffing 17. The second stuffing 17 gives the same resistance that can be experienced by the practitioner when he inserts the needle body into the skin and advances the needle body into the human body. The length of the second stuffing 17 and its number may be adjusted appropriately to usage patterns. The second stuffing 17 may be made of a laminated body comprising multiple layers composed of different materials. The second stuffing 17 may be made of a cotton, a sponge, plastics, a silicone resin, a rubber, a polysaccharide, a protein, a synthetic chemical sponge, foamed plastics, a synthetic fiber, a natural fiber, a raw meat from livestock/fish, a processed meat (ham, etc.), an electrically conductive paste, an electrically conductive gel alone or in combination. The point 19 of the needle body 11 advances to a point apart from the upper end of the second stuffing 17 by a distance S2. If this needle is used for double-blind test, S2 is made equal to S1 (S2=S1).

The needle handle 12 is attached to the upper end of the needle body. The guide tube 13 has on its top end a stopper 15 to prevent the entry of the lowest end of handle 12 into the guide tube 13. The stopper 15 may be placed outside or inside of the guide tube 13. If the stopper 15 is placed outside the guide tube 13, it may movably hold the needle body in such a way as to allow the needle body to pass along the central axis and have a material to give resistance, during its passage through the stopper 15, which is approximately the same as the resistance as that by the stuffing holding needle body 14 during the needle body pass through as described above in relation with the safety needle. The stopper having such functions as described above will be called a "needle body holding stopper means." The lower stuffing (the second stuffing) in a placebo needle with a needle body holding stopper means will be called a "stuffing giving skin puncture like sensation."

Figure 12:
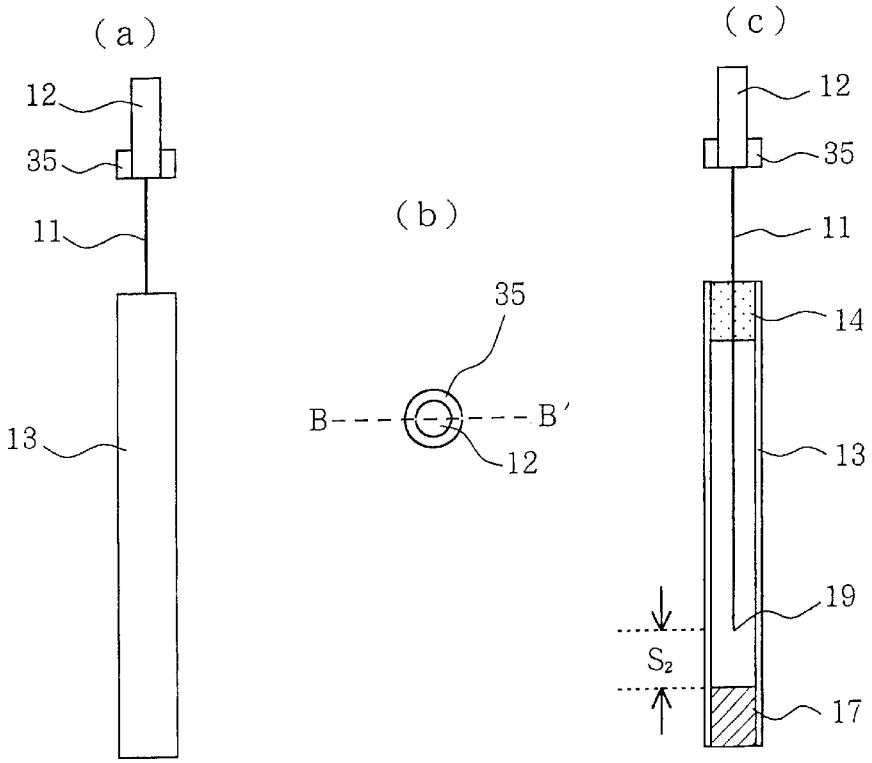
FIG. 12 shows the placebo needle of the present invention in the condition before use which has the stopper on the lowest end side of its needle handle.

Such a stopper 15 should be preferably shaped like a film, a sheet, a plate, a bulk, a cylinder, a clip, etc., and have a diameter not large than the outer diameter of the guide tube 13. The stopper 15 may be placed at the lower end of the needle handle 12, instead of at the side of the guide tube 13. FIG. 12 shows the placebo needle of the present invention before use having the stopper 35 attached to the lowest end of the needle handle 12: FIG. 12(*a*) is a frontal view; FIG. 12(*b*) a top view; and FIG. 12(*c*) a sectional view of the needle cut along line B–B' in FIG. 12(*b*).

The embodiments of the stopper of the placebo needle may take the same configurations (figures being omitted here) as those of the safety needle that are shown in FIGS. 10 and 11.

Figure 4:
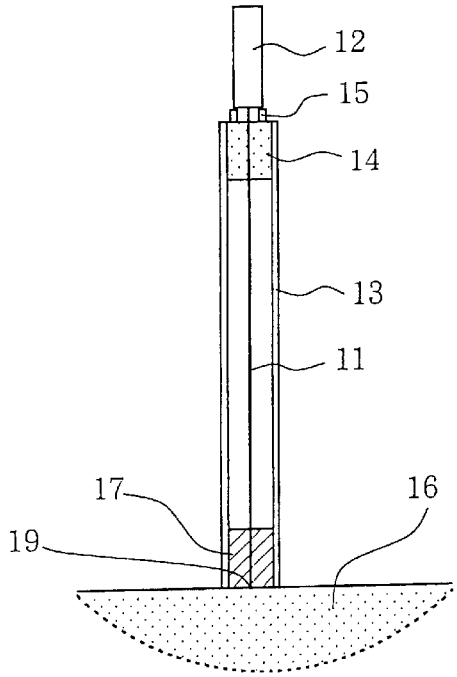
FIG. 4 shows how the placebo needle of FIG. 3 is applied onto the human skin surface.

FIG. 4 shows how the placebo needle of FIG. 3 is applied onto the human skin surface 16.

If the first stuffing is made of a material which has resistance to cancel resistance the practitioner would feel when he inserts the needle body into the skin, and advances the needle body through the skin, if therapy is practiced by the amateur acupuncturist or the practitioner unaccustomed to the technique, if shallow insertion of the safety needle is required, if the patient has the thin and soft skin, or if the needle is applied to the soft subcutaneous tissue in the portion a needle applied, the second stuffing 17 may be omitted.

Pedestal

Figure 5:
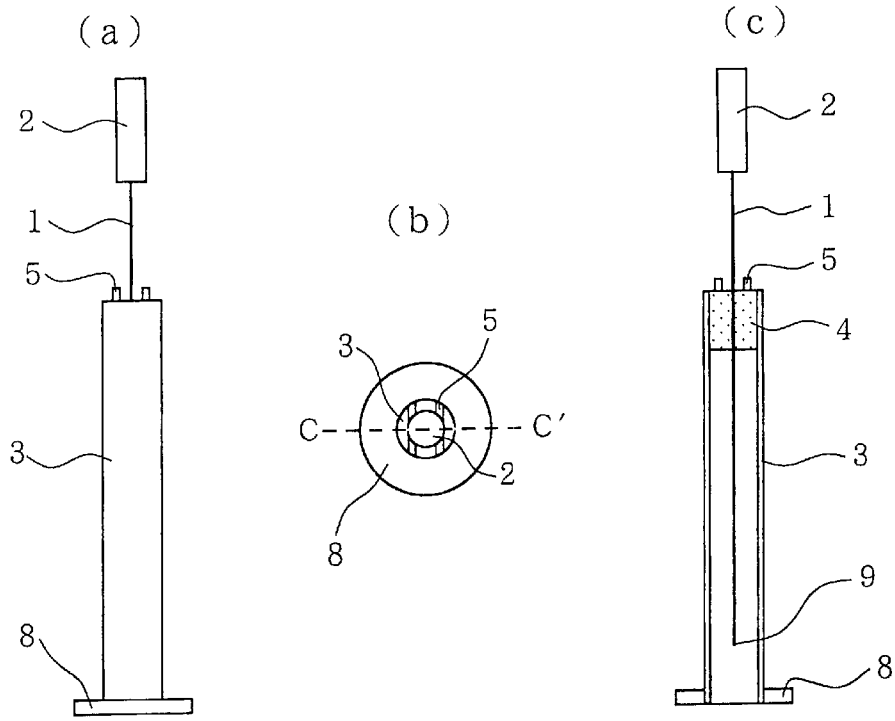
FIG. 5 shows the safety needle of FIG. 1 having the pedestal integratively united to its lowest end, which has the adhesive layer on its undersurface to firmly stick to the human skin surface.

FIG. 5 shows the safety needle of FIG. 1 having the pedestal 8 attached to its lowest end. The pedestal 8 has adhesive materials or a sucking disk on its undersurface to firmly stick to the human skin surface by adhesion or suction. FIG. 5(*a*) is a frontal view; FIG. 5(*b*) a top view; and FIG. 5(*c*) a sectional view of the needle cut along line C–C' in FIG. 5(*b*). The pedestal 8 may be integratively united with the guide tube 3, or it may be separately prepared and then united removably with the guide tube 3. Alternatively, the guide tube 3 may have the adhesive undersurface to be suitably used as in-situ needle, instead of having the pedestal 8 on its bottom end.

Such a means is useful when the safety needle is used for therapy.

Figure 6:
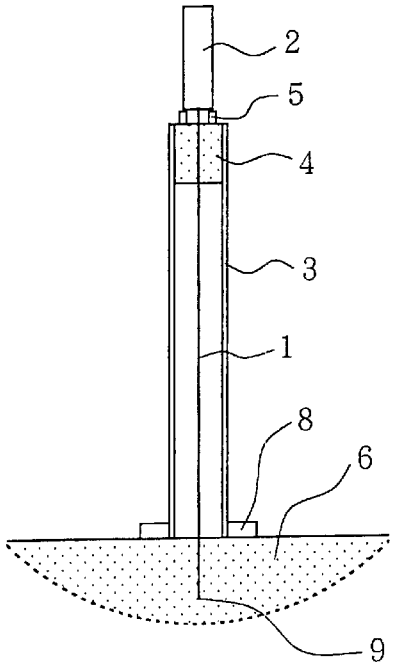
FIG. 6 shows how the safety needle of FIG. 5 is inserted through the skin into the human body.

FIG. 6 shows how the safety needle of FIG. 5 is inserted through the skin into the human body 6. As shown in the FIG. 6, because the guide tube 3 has the adhesive or sucking pedestal 8, it is stabilized on the skin surface during therapy, and keeps the needle body 1 to be stably inserted for an arbitrary period (in-situ needle).

If a safety needle is deeply inserted, and the length of the guide tube 3 and the length and diameter of the needle body are appropriately adjusted, the safety needle does not necessarily require the use of the pedestal 8 to serve as in-situ needle. However, if a needle must be shallowly inserted in spite of its being used as in-situ needle, if an inserted needle must be stabilized, or if a needle is used for electroacupuncture, the safety needle should be preferably used in combination with the pedestal 8.

Figure 7:
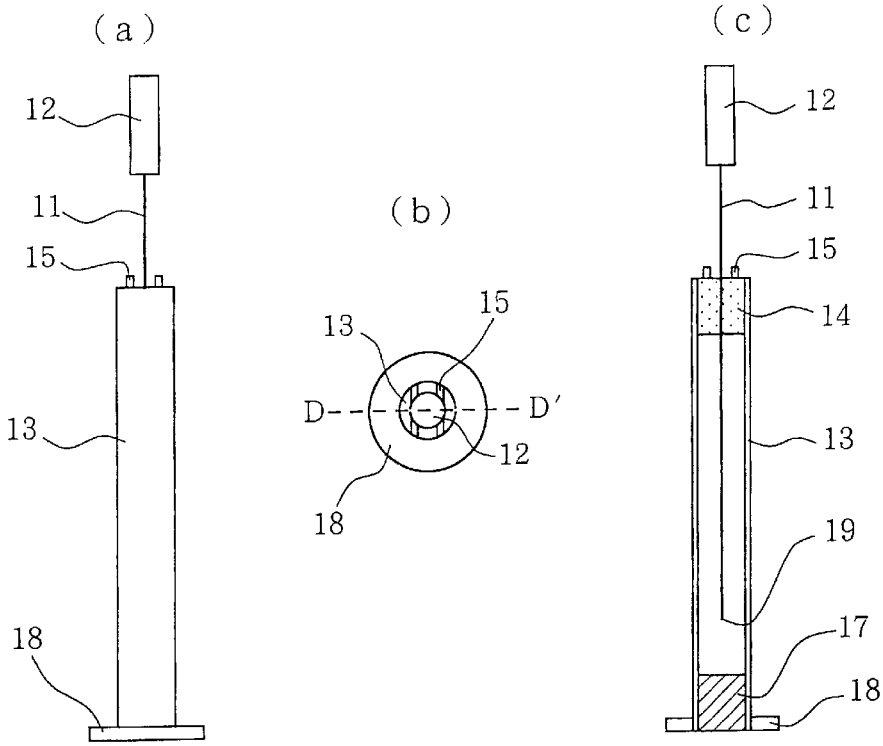
FIG. 7 shows the placebo needle of FIG. 3 having the pedestal integratively united to its lowest end, which has the adhesive layer on its undersurface to firmly stick to the human skin surface.

FIG. 7 shows the placebo needle of FIG. 3 having the pedestal 18 attached to its lowest end. The undersurface of the pedestal 18 has adhesive materials or a sucking disk on its undersurface to firmly stick to the human skin surface by adhesion or suction. FIG. 7(*a*) is a frontal view; FIG. 7(*b*) a top view; and FIG. 7(*c*) a sectional view of the needle cut along line D–D' in FIG. 7(*b*). The pedestal 18 may be integratively united with the guide tube 13, or it may be separately prepared and then united removably with the guide tube 13.

Figure 8:
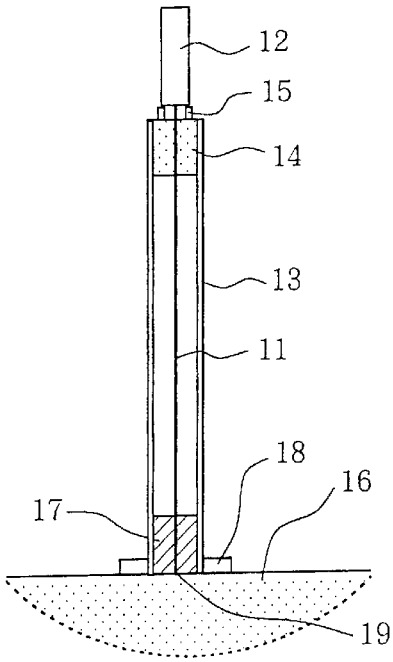
FIG. 8 shows how the placebo needle of FIG. 7 is applied onto the human skin surface.

FIG. 8 shows how the placebo needle of FIG. 7 is applied onto the skin surface of the human body 16. As shown in the FIG. 8, because the guide tube 13 has the adhesive or sucking pedestal 18, it is possible to stably place the placebo needle containing the guide tube 13 onto the skin.

If both the safety needle and the placebo needle are used with the adhesive or sucking pedestal 8 or 18, it can be easy to maintain their being used as in-situ needles (needle body is inserted into the human body and kept there for an arbitrary period).

Lowest Ends of a Safety Needle and a Placebo Needle

Figure 13:
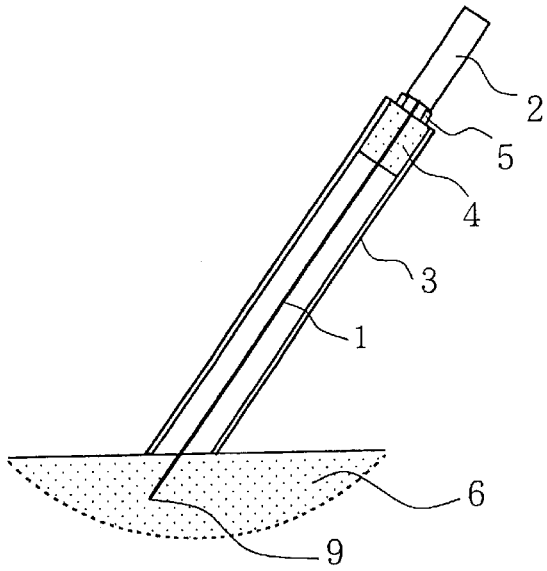
FIG. 13 shows how the safety needle is placed at an arbitrary angle to the skin if it must be inserted obliquely through the skin into the human body.
Figure 14:
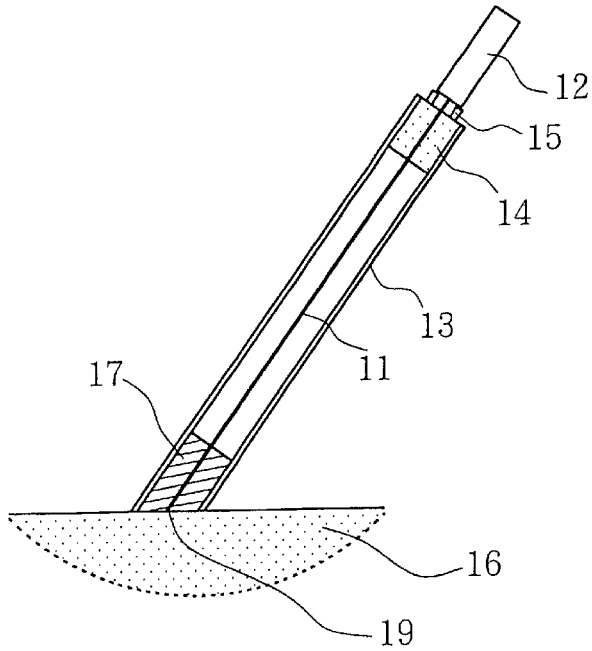
FIG. 14 shows how the placebo needle is placed at an arbitrary angle to the skin if it must be pressed obliquely on the skin.

When it is necessary to insert a safety needle obliquely onto the human skin surface, it is better to use the guide tube 3 having its bottom end cut obliquely as shown in FIG. 13. Similarly for a placebo needle, the guide tube 13 should preferably have its bottom end cut obliquely as shown in FIG. 14. For the guide tube 3 and 13 shown in FIGS. 13 and 14 whose bottom ends have been cut obliquely, their length is determined by measuring along the central axis. When it is necessary to attach the pedestal to the obliquely cut end of the guide tube 3 and 13, the pedestal should be adjusted of its form to fit the form of the cut end of the guide tube 3 and 13.

Needle Set for Double-blind Test

A safety needle and a placebo needle as described above may be combined into a set for double-blind test. For this purpose, the two kinds of the needles should be made the same in appearance with each other: the lengths of the guide tube 3 and 13, the lengths of the needle body protruding from the top end of the guide tube 3 and 13, and the lengths of the needle handle 2 and 12 of the two kinds of the needles must be the same; and the distance $S_1$ from the point 9 of the needle body contained in the safety needle to the skin surface must be the same as the distance $S_2$ from the point 19 of the needle body 11 contained in the placebo needle to the upper surface of the second stuffing 17. In short, the two kinds of the needles must be the same in shape and color.

The stuffing holding needle body 4 contained in the safety needle and the first stuffing 14 contained in the placebo needle should be preferably made of the same material, and the guide tube 3 and 13 should be preferably made opaque to make their interior invisible from outside. And, it is preferable that the guide tubes 3 and 13 may have their bottom ends covered with covers (not illustrated here) to make their interior invisible from outside. The cover should be sterilized in advance, shaped like a film, a sheet, a plate, or a bulk, and made of an alcohol-soaked cotton, a sponge, a synthetic chemical sponge, plastics, a paper, a gauze, a protein, or a polysaccharide alone or in combination. The cover may be substituted for electro-conductive paste (applied to the end of the guide tube to form a cover), an electrically conductive jelly, or an electrically conductive pad.

If, before a safety needle and a placebo needle are used, each needle body 1 and 11 is marked at the same position as the top end of the guide tube 3 and 13(including the thickness of the stopper protruding from the top end of the guide tube), it will be easy to replace the needle body 1 and 11 to the positions before use, after therapy.

The total length of the guide tubes 3 and 13 should be made equal to the length that the length of the needle body of the safety needle minus that of the desired insertion depth. If the guide tubes 3 and 13 have the stoppers on its outside, the height of stopper should be added to the minus term. The insertion depth may vary according to the site to be treated, and thus the length of the guide tube 3 and 13 should be adjusted appropriately.

When the bottom end of the needle handles 2, 12 reach at the top end of the guide tubes 3 or 13, the needle bodies I or 11 are prevented from advancing further because of the stoppers 5, 15, 25 or 35 placed on the top end of the guide tubes 3 or 13, or on the lowest end of the needle handles 2 or 12 of the two kinds of the needles. Thus, if the length of the needle body 11 of the placebo needle is equal to that of the guide tube 13, the possible moving distances of the needle bodies 1 and 11 are the same for their application, the distances the needle body 1 and 11 move will be the same in application of the two kinds of the needle. If the needle body 11 of placebo needles is made slightly longer or shorter than the guide tube 13, the distances passed through of the two kinds of the needles will be about the same.

The safety needle will be inserted into the human body by a distance equal to the length that the needle body 1 minus the length of the guide tube 3. If the guide tube 3 has the stopper 5 on its outside, the height of the stopper 5 should be added to the minus term. The length of the needle body 11 of the placebo needle should be adjusted such that the point 19 of the needle body 11 falls in a range from a position at which the needle point 19 can give pressure on the skin to a position just on the skin surface, at the moment when the needle body 11 is stopped by stoppers 15 or 35 during needle insertion by twirling or simple insertion with the Sashide. To obtain a placebo needle having such length as described above, it is recommended to cut its needle body 11 at a point so that its length is slightly longer or shorter than the length of the guide tube 13. The point 19 of the needle body 11 should preferably have form impenetrable to the skin (for example, having a blunt tip). The length of the needle body 11 and shape of the point 19 of the needle body 11*a* of the placebo needle may be varied according to the desired intensity of stimulation with that needle.

Because both the safety needle and placebo needle have the guide tubes 3 and 13 which have stuffings holding needle body 4 and 14 (first stuffing for the placebo needle) plugged and fixed within their cavities, the needle bodies 1 and 11 receive resistance against the motion in the straight direction or the rotary motion of the needle bodies 1 and 11 during needle insertion or needle removal. The intensity of resistance may be adjusted appropriately according to the usage patterns, treatment method, the point to be treated and the insertion depth. Because sensation from this resistance cancels the sensation of resistance which the practitioner experiences through his Sashide when he inserts or removes the needle into or from the body, the practitioner can not distinguish a safety needle from a placebo needle.

Furthermore the guide tube 13 of a placebo needle has the second stuffing 17 plugged and fixed in its cavity. The second stuffing 17 may be plugged and fixed at a position such that its lower surface is close to or corresponds to the position of the bottom end of the guide tube 13. On the other hand, the upper surface of the second stuffing 17 is at a position higher than the bottom end of the guide tube 13 by an amount equal to the difference between the length of the needle body of the safety needle and that of the corresponding placebo needle (or equal to the depth by which the needle body 1 of the safety needle is inserted into the human body 6). In application of the safety needle and the placebo needle of which the guide tube 13 has the second stuffing 17 arranged as above, the portions of the needle body 1, 11, and of handle 2, 12 protruding from the guide tube 3, 13 are made equal in length between two kinds of the needles; and then the distance $S_1$ i.e. the distance passed through from the point 9 of the needle body 1 of the safety needle to the skin surface becomes equal to the distance $S_2$ i.e. the distance passed through from the point 19 of the needle body 11 of the placebo needle to the upper surface of the second stuffing 17 plugged and fixed at the bottom end of the guide tube 13 ($S_1$=$S_2$), provided that the length of the needle body 11 of the placebo needle is the same as that of the guide tube 13. If the length of the needle body 11 of the placebo needle is slightly less or more than the length of the guide tube 13, the distances passed through of the needle body 1 and 11 will become nearly equal.

A needle set in which the safety and placebo needles are related to each other in the manner as described above, is applied to human body 6,16: when the point 19 of the needle body 11 of the placebo needle advances by distance equal to $S_1$ or distance from the point 9 of the needle body 1 of the safety needle to reach the skin surface, it reaches the upper surface of the second stuffing 17; and thus when the point 19 of the needle body 11 of the placebo needle advances further, the needle stem receives resistance from the second stuffing 17 equal to the resistance that by the needle stem 1 of the safety needle may be receive when it reaches the skin and advances through the human body 6. Accordingly, the practitioner feel difficulty in distinguishing the two kinds of the needle during execution of therapy, and thus this needle set enable to mask the practitioner.

With such a needle set as above, if the first stuffing is made of a material which has resistance to cancel resistance the practitioner feels when he inserts a needle body into the skin and advances it through the skin, if therapy is practiced by an amateur acupuncturist or a practitioner unaccustomed to the needling technique, if shallow insertion of a safety needle is required, if the patient has the thin and soft skin, or if the needle is be applied to the soft subcutaneous tissue, the second stuffing 17 may be omitted. But if needling techniques other than simple insertion or in-situ needle such as sparrow pecking, needle twirling technique, etc. are required, it is preferable to apply the second stuffing, because the first stuffing must have lower resistance than that in the case of simple insertion or in-situ needle.

Another method to mask the difference between a safety needle and a placebo needle is as follows. A group of the safety needles is prepared by selecting, according to the purpose of given double-blind test, appropriate ones different in one or more features from among the safety needles that are different in the material of the needle handle, length, color, or shape; in the material of the needle body, total length, diameter, length protruding from the top end of the guide tube or from the upper end of the needle body holding stopper means, distance from its point to the skin, or insertion depth; in the material of the guide tube, length, color or shape; and in the material of the stuffing holding needle body, quantity, number or position.

Another group comprising placebo needles is prepared by selecting, according to the purpose of given double-blind test, appropriate ones different in one or more features from among the placebo needles that are different in the material of the needle handle, length, color or shape; in the material of the needle body, total length, diameter, or length protruding from the top end of the guide tube or from the upper end of the needle body holding stopper means, the distance from the point to the upper surface of the second stuffing; in the material of the guide tube, length, color or shape; in the material of the first stuffing holding needle body, the quantity, the number or the position; and in the material of the second stuffing, its quantity, number or position.

Next, the groups of the safety needles and placebo needles that are different in one or more features are combined into a needle set for double-blind test. The individual safety needle and placebo needle that have been selected as above to be different in one or more features are combined to give a needle set for double-blind test. Thus, the safety needle and placebo needle thus combined can not be distinguished from appearance by the practitioner or by the subject, because its combination is randomly formed according to the purpose ot given double-blind test. The use of those needles will ensure double-blindness.

Needle Set for Double-blinding the Diameter of the Needle Body

When combining needles as above to prepare a needle set for double-blind test, attention is paid, for example, to the diameter of the needle. Selecting safety needles and placebo needles different in diameter, and combining them into various pairs of the safety and placebo needles that are the same in appearance, though being different in diameter. Then, it is possible to carry out double-blind test masking the diameter of the needles from the practitioner and the subject. The needle set comprising such a combination of the needles will be called a needle set for diameter double-blinding the diameter of the needle body.

Needle Set for Double-blinding the Depth of the Needle Body

When combining needles as above to prepare a needle set for double-blind test, attention is paid, for example, to the insertion depth of the needle body. Selecting safety needles different in insertion depth of the needle body, and placebo needles different in the length of the needle body, and combining them into various pairs of the safety and placebo needles that are the same in appearance, though being different in length. Then, it is possible to carry out double-blind test masking the insertion depth of the needle body from the practitioner and the subject. The needle set comprising such a combination of the needle body will be called a needle set for depth double-blinding.

Another needle set for depth double-blinding whereby insertion depth can be double-blinded is described below.

Such a needle set comprises depth masking needles which are different in insertion depth. The group of the needle set for depth double-blinding comprises the needles that are different in insertion depth as well as in the guide tube length, and another group of the needle set for depth double-blinding comprises the needle bodies that are different in insertion depth, although their guide tube length is the same. The guide tube is preferably made opaque to make their interior invisible from outside.

i) Needle set comprises needles which are different in insertion depth as well as in guide tube length.

This type of depth double-blind needle set comprises, as the first group, depth masking needles that have following elements (1) to (4), and are different in insertion depth as well as in guide tube length. Thus, each of the depth masking needle classified to the first group may have the same shape as that of the safety needle as depicted in FIG. 1, and comprises: (1) a guide tube; (2) one or more stuffings holding needle body which is plugged and fixed at a desired position in the cavity of the guide tube, gives resistance during passage of the needle body therethrough, and holds the needle body; (3) the needle body movably held by the stuffing and the needle body is longer than the guide tube by an amount equal to the insertion depth of the needle body; and (4) the stopper which is placed on the lowest end of the needle handle attached to the top end of the needle body, or on the top end of the guide tube, and serves as the stopper to prevent the needle handle from entering into the guide tube at the moment when the point of the needle body reaches to a specified insertion depth. If the needle set for depth double-blind test comprises only the first group of depth masking needles, the stuffing holding needle body should preferably give resistance sufficiently large to cancel resistance that by the needle body may be received when it reaches the skin surface and penetrates into the human body.

The depth double-blind needle set as above may comprise needles which have the needle body holding stopper means, instead of the stuffing holding needle body and the stopper. The needle body holding stopper means is placed on the top end of the guide tube, prevents the needle handle from entering into the guide tube when the point of the needle body reaches to the specified insertion depth, and thus not only holds the needle body but gives resistance to it during its passage there through.

When such a needle set for depth double-blind test as described above is used for double-blind test, the needles are different in the length of the guide tube, the length of the needle body relative to the length of the guide tube, the length of the needle body protruding from the top end of the guide tube, and the insertion depth of the needle body, and thus neither the practitioner nor the subject can know from appearance the insertion depth of any given needle. The practitioner could not tell whether any given needle is a safety needle or a placebo needle, from the sensation which he received when he inserts the needle body into the skin and advances through human body, and he could not tell the insertion depth of that needle. Thus, the insertion depth is doubly blinded.

A still further second group of depth double-blind needle set which is different in the length of the guide tube, and in the insertion depth of the needle body is obtained by plugging the stuffing at the lower end of the guide tube that can give similar resistance that by the needle body may be received when it reaches the skin surface and penetrate into the human body, during passage of the needle body therethrough. Namely, the depth masking needle set for double-blind test comprises: (1) a guide tube; (2) one or more stuffings holding needle body which is plugged and fixed at a desired position in the cavity of the guide tube, gives resistance to the needle body during its passage therethrough, and holds the needle body; (3) one or more stuffings giving skin puncture like sensation which is plugged and fixed at a lower position in the cavity of the guide tube, and gives the similar sensation to the skin puncture and tissue penetration while the needle body advances through the cavity of the guide tube to reach to the specified depth; (4) the needle body movably held by the stuffing and the needle body is longer than the guide tube by an amount equal to the insertion depth of the needle body; and (5) a stopper which is placed on the lowest end of the needle handle attached to the top end of the needle body, or on the top end of the guide tube, and serves as the stopper to prevent the needle handle from entering into the guide tube at the moment when the point of the needle body reached to the specified insertion depth.

The depth masking needle set may comprise needles which have a needle body holding stopper means, instead of a stuffing holding needle body and a stopper. The needle body holding stopper means is placed on the top end of the guide tube, prevents the needle handle from entering into the guide tube when the point of the needle body reaches to the specified insertion depth, and thus not only holds the needle body but gives resistance to it during its passage therethrough.

When such a needle set for double-blind test as described above is used for depth double-blind test, the needles are different in the length of the guide tube, the length of the needle body relative to the length of the guide tube, the length of the needle body protruding from the top end of the guide tube, the length of stuffing giving skin puncture like sensation, and the insertion depth of the needle body, and thus neither the practitioner nor the subject can know from appearance the insertion depth of any given needle. The practitioner could not tell whether any given needle is a safety needle or a placebo needle, from the sensations which he received when he inserts the needle body into the skin and the human body, and he could not tell the insertion depth of that needle body. Thus, if a needle is randomly selected from those depth masking needles, and applied to the subject, it will be possible to blind both the practitioner and the subject to the insertion depth of that needle.

Further, if two or more needles are randomly selected one half from the first group of the depth masking needles and the other half from the second group of the depth masking needles, and combined, they will give the needle set for double-blind test with which it is possible to blind the insertion depth of the needle body.

The stuffing holding needle body to be applied to the depth masking needle may be made of the same material as used in the safety needle, or as used for the first stuffing of the placebo needle.

The stuffing giving skin puncture like sensation to be applied to the depth masking needle may be made of the same material as used for the second stuffing of the placebo needle, provided that it poses no sanitation problem. The stuffing giving skin puncture like sensation may be made of, for example, alcohol-soaked cotton, and its length and density, and the position in the cavity of the guide tube may be adjusted appropriately according to the usage pattern. The alcohol-soaked cotton may be divided into two or more portions for use. Instead of alcohol-soaked cotton, the stuffing may be made of other sterilized material (material which will not pose any sanitation problem, even when the point and needle body penetrates the body after passing through that material, for example, alcohol-soaked gauze or paper).

ii) Needles which are the same in the length of the guide tube, the length of the needle body protruding from the top end of the guide tube, and the length of the needle handle, but different in insertion depth are combined to form a depth double-blind needle set.

Of the needle set for depth double-blind test containing both the stuffing holding needle body and the stuffing giving skin puncture like sensation as described above in the second group of i) those that are the same in the length of the guide tube, the length of the needle body protruding from the top end of the guide tube, and the length of the needle handle, but different in insertion depth are selected, and combined into a depth double-blind needle set. The position of stuffing giving skin puncture like sensation (the lowest stuffing) of all the stuffings should be preferably determined according to the needle which has the largest insertion depth in that group. The distance from the upper surface of the stuffing to the point of the needle body of other shorter needle than the longest needle should be preferably equal to the distance from the upper surface of the stuffing to the point of the needle body of the longest needle with which the insertion length is the deepest. The first group of the needles as mentioned in paragraph i) may be used as the needle set as described above.

Needle Set for Double-blinding the Acupoint

If it is necessary to make the practitioner unaware of whether a needle is applied to an acupoint or the non-acupoint, the third person may place a needle assembly with the pedestal of this invention (the safety needle or the placebo needle) at an acupoint or a nonacupoint to enable application, and then the practitioner inserts the needle there. In this case, the needle assembly with pedestal will enable this invention mask the point for needle application(whether it is an acupoint or a non-acupoint) from the practitioner as well as the subject.

Therapy With a Safety Needle

To practice therapy with the safety needle of this invention, the practitioner first inserts the guide tube 3 of the safety needle between the pads of thumb and index finger of Oshide being formed on the skin; holds the guide tube 3; taps the top end of the needle handle 2 by the Sashide (hand to advance or remove a needle) to penetrate the skin with the point 9 of the needle body 1; advances by twirling or by simple insertion technique until it is stopped by the stopper 5 or 25 placed on the lower end of the needle handle 2 or on the top end of the guide tube 3; and just at that moment the point 9 of the needle body 1 reaches a desired position in the human body 6. Needle insertion may be performed by twirling technique without tapping the top end of the needle handle 2 by the Sashide depending on the intensity of resistance given by the stuffing holding needle body 4 during passage of the needle body 1 therethrough, or on the length of the needle body 1 protruding from the top end of the guide tube. Therapy with in-situ needle consists of leaving the inserted needle for an arbitrary period. When a therapy with in-situ needle is practiced, it is preferable to apply the safety needle with the pedestal on the skin, because it will be easy to maintain there the in-situ needle. Then, practitioner holds the guide tube by Oshide, and removes the needle until the needle replace the original position by Sashide. When the safety needle has the guide tube with the pedestal of this invention, Oshide will not be required. At this stage, the part of the needle body 1 which has been inserted into the human body 6 is put back into the cavity of the guide tube 3. The guide tube 3 containing the needle body 1 in the manner as described above is removed from the human body 6, and is discarded into a specified container.

Industrial Applicability

In the present invention, the tip of the needle body as the component of the safety needle is contained in the cavity of a guide tube as the component of the safety needle, during storage, therapy and post-therapy period. The needle body is not separated from the guide tube at any time. Therefore, the acupuncture therapist and disposer for the use and/or disposal of the needle are protected against direct exposure to the needle body and its point. This indicates that a person who handle an acupuncture needle can be free from the risk of infection from the patient to the practitioner, from the practitioner to a third person, by damaging themselves by accident with the contaminated needle and exposure to infection of the practitioner and the disposer who might otherwise contaminate themselves by damaging themselves by accident with the needle.

With the safety needle of the present invention, it is possible to prevent by the needle body which has reached a desired depth from advancing further by a stopper. Through this arrangement, it is possible to minimize unnecessary damages to a tissue or to an important organ. This is particularly important when therapy is applied to the thorax or the abdomen, because the thorax and the abdomen contain many important organs, and thus to apply therapy there the precise placement of a needle is required. In therapy with a conventional needle, the practitioner determines the insertion depth of the needle depending on his subjective impression or feeling, he might insert the needle by accident deeper than is necessary, or stop it before reach. Therapy with in-situ needle may present problems: the needle advances inadvertently deeper than is desired, as a result of the weight of the needle body/handle themselves, or of an object such as the towel placed on the needle, or of the muscle contraction. The safety needle of this invention is free from those problems because it has the stopper.

The needle set of this invention for double-blind test makes it possible for the first time to carry out double-blind test for strictly evaluating the therapeutic effect of acupuncture in which both the practitioner and the subject are blinded whether a real needle or a placebo needle are used.

When the safety needles the needle bodies of which are different in the length of the guide tube and in the length of the needle body relative to the length of the guide tube are used for therapy, it is possible to carry out double-blind test in which the insertion depth of the needle is masked.

When the safety needles are used for therapy the needle bodies of which are different in the diameter of the needle body, it is possible to carry out double-blind test in which the diameter of the needle body can be masked.

Because the safety needle and the placebo needle of this invention are movably held by the stuffing in the cavity of the guide tube, it is possible to straightly move the needle during needle insertion or needle removal, and thus the guide tube also serves as Oshide. When an adhesive pedestal is attached, it is possible to stabilize the needle (safety needle or placebo needle) being kept in the guide tube, which may dispense with Oshide.

The needle assembly with the pedestal will enable this invention to mask the point for needle application masking the nature of site (whether it is an acupoint or a non-acupoint) from the practitioner as well as the subject.

What is claimed is:

1. A safety needle comprising:

(1) a guide tube;

(2) one or more stuffings holding needle body which are plugged into the guide tube to be fixed at a desired position, to give resistance to a needle body during its passage therethrough, and to hold the needle body;

(3) the needle body movably held by the stuffing which has the length longer than that of the guide tube by an amount equal to the insertion depth of the needle body; and (4) a stopper which is mounted to the lower end of a needle handle attached to the top of the needle body, or which is mounted to the top end of the guide tube, and prevents the needle handle from advancing further at the moment when the needle point reach a specified insertion depth;

(5) wherein the guide tube is longer than the insertion depth of the needle body.

2. A safety needle comprising:

(1) a guide tube;

(2) a needle body holding stopper means which is mounted outside the top end of the guide tube, and which prevents a needle handle from advancing further into the guide tube when the point of the needle body reaches a specified insertion depth, and not only holds the needle body but gives resistance to it during its passage therethrough; and (3)the needle body movably held by the needle body holding stopper means which has the length longer than the distance from the end of the guide tube in contact with the skin to the end of the needle body holding stopper means to be in contact with the needle handle by an amount equal to the insertion depth of the needle body, (4) wherein the distance from the end of the needle body holding stopper means to be in contact with the needle handle from the end of the guide tube to be in contact with the skin is larger than the insertion depth of the needle body.

3. A safety needle as described in claim 1 or 2 wherein the guide tube has an adhesive or a sucking pedestal on the surface of its base to be in contact with the skin.

4. A placebo needle comprising:

(1) a guide tube;

(2) one or more first stuffings which are plugged into the guide tube to be fixed at a desired position, to give resistance to a needle body during its passage therethrough, and to hold the needle body;

(3) one or more second stuffings which are plugged into lower position of the guide tube and fixed, to give similar sensation to the skin puncture and the tissue penetration during passage of the needle body therethrough to reach a specified depth;

(4) the needle body movably held by the first stuffing which has the length sufficiently long to allow its point to stop at a position prior to penetrating the skin surface when the needle body is advanced through the cavity of the guide tube as far as possible; and (5) a stopper which is mounted to the lower end of the needle handle attached to the top of the needle body, or which is mounted to the upper end of the guide tube, and prevents the needle handle from advancing further into the guide tube when the point of the needle body reaches the position prior to penetrating the skin surface.

5. A placebo needle comprising:

(1) a guide tube;

(2) a needle body holding stopper means which is mounted outside the top end of the guide tube, and which prevents the needle handle from advancing further into the guide tube when the point of the needle body reaches a position prior to penetrating the skin surface, and not only holds the needle body but gives resistance to it during its passage therethrough;

(3) one or more stuffings giving skin puncture like sensation which are plugged into the guide tube to be fixed at a lower position, to give sensations indicative to the skin puncture and the tissue penetration during passage of a needle body through the cavity of the guide tube to reach the specified depth; and (4) the needle body movably held by the needle body holding stopper means which has the length sufficiently long to allow its point to stop at the position prior to penetrating the skin surface when the needle body is advanced through the cavity of the guide tube as far as possible.

6. A placebo needle comprising:

(1) a guide tube;

(2) one or more stuffings holding needle body which are plugged into the guide tube to be fixed at a desired position, to give resistance to the needle body during its passage therethrough;

(3) the needle body movably held by the stuffing holding needle body which has the length sufficiently long to allow its point to stop at a position prior to penetrating the skin surface when the needle body being advanced through the cavity of the guide tube as far as possible; and (4) a stopper which is mounted to the lower end of a needle handle attached to the top of the needle body, or which is mounted to the top end of the guide tube, and prevents the needle handle from advancing further into the guide tube when the point of the needle body being advanced through the cavity of the guide tube reaches the position prior to penetrating the skin.

7. A placebo needle comprising:

(1) a guide tube;

(2) a needle body holding stopper means which is mounted outside the top end of the guide tube, and which prevents a needle handle from advancing further into the guide tube when the point of the needle body reaches a position prior to penetrating the skin surface, and not only holds the needle body but gives resistance to it during its passage therethrough; and (3) the needle body movably held by the needle body holding stopper means which has the length sufficiently long to allow its point to stop at the position prior to penetrating the skin surface when the needle body is advanced through the cavity of the guide tube as far as possible.

8. A placebo needle as claimed in claim 4, 5, 6 or 7 wherein the point of the needle body takes a form impenetrable to the body.

9. A placebo needle as claimed in claim 4, 5, 6 or 7 wherein the guide tube has an adhesive or sucking pedestal on the surface of its base to be in contact with the skin.

10. Needle set for double-blinding depth obtained by combining two or more needles selected one from a first group of depth masking needles and the other from a second group of depth masking needles, the first group comprising plural masking needles each of which includes:

(1) a guide tube;

(2) one or more stuffings holding needle body which are plugged into the guide tube to be fixed at a desired position, to give resistance during passage of a needle body therethrough, and to hold the needle body;

(3) the needle body movably held by the stuffing which has length longer than that of the guide tube by an amount equal to the insertion depth of the needle body; and (4) a stopper which is mounted to the lower end of a handle attached to the top of the needle body, or to the top end of the guide tube, and prevents the needle handle from advancing further into the capacity of the guide tube when the point of the needle body reaches a specified insertion depth, (5) wherein those plural depth masking needles are different in the length of the guide tube, the length of the needle body relative to the length of the guide tube, the length of the needle body protruding from the top end of the guide tube, and the insertion depth of the needle body; and the second group comprising plural masking needles each of which includes:

(6) a guide tube;

(7) one or more stuffings holding needle body which are plugged into the guide tube to be fixed at a desired position, to give resistance during passage of a needle body therethrough, and to hold the needle body;

(8) one or more stuffing giving skin puncture like sensations which are plugged into the guide tube to be fixed at a lower position, to give similar sensation to the skin puncture and the tissue penetration during passage of the needle body through the cavity of the guide tube to reach a specified depth;

(9) the needle body movably held by the stuffing holding needle body which has length longer than that of the guide tube by an amount equal to the insertion depth of the needle body; and

(10) a stopper which is mounted to the lower end of a needle handle attached to the top of the needle body, or to the top end of the guide tube, and prevents the needle handle from advancing further into the cavity of the guide tube when the point of the needle body reaches a specified insertion depth,

(11) wherein those plural depth masking needles are different in the length of the guide tube, the length of the needle body relative to the length of the guide tube, the length of the needle body protruding from the top end of the guide tube, the length of the stuffing giving skin puncture like sensation, and the insertion depth of the needle body.

11. A needle set for double-blinding depth obtained by combining two or more needles selected one from a first group of depth masking needles and the other from a second group of depth masking needles, the first group comprising plural masking needles each of which includes:

(1) a guide tube;

(2) a needle body holding stopper means which is mounted outside the top end of the guide tube, and which prevents a needle handle from advancing further into the cavity of the guide tube when the point of a needle body reaches a specified insertion depth, and not only holds the needle body but gives resistance to it during its passage therethrough; and (3) the needle body movably held by the stuffing which has length longer than the distance from the end of the guide tube to be in contact with the skin to the end of the needle body holding stopper means to be in contact with the needle handle by an amount equal to the insertion depth of the needle body, (4) wherein those plural depth masking needles are different in the length of the guide tube, the length of the needle body relative to the length of the guide tube, the length of the needle body protruding from the top end of the guide tube, and the insertion depth of the needle body; and the second group comprising plural masking needles each of which includes:

(5) a guide tube;

(6) a needle body holding stopper means which is mounted outside the top end of the guide tube, and which prevents a needle handle from advancing further into the cavity of the guide tube when the point of the needle body reaches a specified insertion depth, and not only holds the needle body but gives resistance to it during its passage therethrough;

(7) one or more stuffing giving skin puncture like sensations which are plugged into the guide tube to be fixed at a lower position, to give similar sensations to the skin puncture and the tissue penetration during passage of the needle body through the cavity of the guide tube to reach a specified depth; and (8) the needle body movably held by the needle body holding stopper means which has the length longer than the distance from the end of the guide tube to be in contact with the skin to the end of the needle body holding stopper means to be in contact with the needle handle by an amount equal to the insertion depth of the needle body, (9) wherein those plural depth masking needles are different in the length of the guide tube, the length of the needle body relative to the length of the guide tube, the length of the needle body protruding from the top end of the guide tube, the length of the stuffing giving skin puncture like sensation, and the insertion depth of the needle body.

12. A needle set for double-blinding depth obtained by combining two or more groups comprising depth masking needles each of which comprises:

(1) a guide tube;

(2) one or more stuffings holding needle body which are plugged into the guide tube to be fixed at a desired position, to give resistance during passage of a needle body therethrough, and to hold the needle body;

(3) one or more stuffings giving skin puncture like sensations which are plugged into the guide tube to be fixed at a lower position, to give similar sensation to the skin puncture and the tissue penetration during passage of the needle body through the cavity of the guide tube to reach a specified depth;

(4) the needle body movably held by the stuffing holding needle body which has the length longer than that of the guide tube by an amount equal to the insertion depth of the needle body; and (5) a stopper which is mounted to the lower end of a needle handle attached to the top of the needle body, or to the top end of the guide tube, and prevents the needle handle from advancing further into the cavity of the guide tube when the point of the needle body being advanced through the guide tube reaches a specified insertion depth, (6) wherein those plural depth masking needles are different in the length of the guide tube, the length of the needle body protruding from the top end of the guide tube, the length of the stuffing giving skin puncture like sensation, and the insertion depth of the needle body.

13. Needle set for double-blinding depth obtained by combining two or more groups comprising depth masking needles each of which comprises:

(1) a guide tube;

(2) a needle body holding stopper means which is mounted outside the top end of the guide tube, and which prevents a needle handle from advancing further into the cavity of the guide tube when the point of the needle body reaches a specified insertion depth, and not only holds the needle body but gives resistance to it during its passage therethrough;

(3) one or more stuffings giving skin puncture like sensations which are plugged into the guide tube to be fixed at a lower position, to give similar sensation to the skin puncture and the tissue penetration during passage of the needle body through the cavity of the guide tube to reach a specified depth; and (4) the needle body movably held by the needle body holding stopper means which has length longer than the distance from the end of the guide tube to be in contact with the skin to the end of the needle body holding stopper means to be in contact with the needle handle by an amount equal to the insertion depth of the needle body, (5) wherein those plural depth masking needles are different in the length of the guide tube, the length of the needle body protruding from the top end of the guide tube, the length of the stuffing giving skin puncture like sensation, and the insertion depth of the needle body.

14. A needle set for double-blind test comprising:

(A) a safety needle according to one of a first construction and a second construction wherein:

the first construction comprises:

(1) a guide tube;

(2) one or more stuffings holding needle body which are plugged into the guide tube to be fixed at a desired position, to give resistance to a needle body during its passage therethrough, and to hold the needle body;

(3) the needle body movably held by the stuffing which has the length longer than that of the guide tube by an amount equal to the insertion depth of the needle body; and (4) a stopper which is mounted to the lower end of a needle handle attached to the top of the needle body, or which is mounted to the top end of the guide tube, and prevents the needle handle from advancing further at the moment when the needle point reach a specified insertion depth;

(5) wherein the guide tube is longer than the insertion depth of the needle body; and the second construction comprises:

(1) a guide tube;

(2) a needle body holding stopper means which is mounted outside the top end of the guide tube, and which prevents a needle handle from advancing further into the guide tube when the point of the needle body reaches a specified insertion depth, and not only holds the needle body but gives resistance to it during its passage therethrough; and (3) the needle body movably held by the needle body holding stopper means which has the length longer than the distance from the end of the guide tube in contact with the skin to the end of the needle body holding stopper means to be in contact with the needle handle by an amount equal to the insertion depth of the needle body, (4) wherein the distance from the end of the needle body holding stopper means to be in contact with the needle handle from the end of the guide tube to be in contact with the skin is larger than the insertion depth of the needle body; and (B) a placebo needle comprising (1) a guide tube;

(2) one or more first stuffings which are plugged into the guide tube to be fixed at a desired position, to give resistance to a needle body during its passage therethrough, and to hold the needle body;

(3) one or more second stuffings which are plugged into lower position of the guide tube and fixed, to give similar sensation to the skin puncture and the tissue penetration during passage of the needle body therethrough to reach a specified depth;

(4) the needle body movably held by the first stuffing which has the length sufficiently long to allow its point to stop just on or above the skin surface when the needle body is advanced through the cavity of the guide tube as far as possible; and (5) a stopper which is mounted to the lower end of the needle handle attached to the top of the needle body, or which is mounted to the upper end of the guide tube, and prevents the needle handle from advancing further to the guide tube when the point of the needle body reaches just on or above the skin surface.

15. A needle set for double-blind test according to claim 14 wherein the point of the placebo needle body takes a form impenetrable to a human body.

16. A needle set for double blind test according to claim 15 wherein the placebo needle guide tube has an adhesive or sucking pedestal on the surface of its base to be in contact with the skin.

17. A needle set for double-blind test according to claim 15, (1) wherein the safety needle and the placebo needle are the same in their guide tube lengths, or in the distance from the end of the guide tube to be in contact with the skin to the end of the needle body holding stopper means to be in contact with the needle handles, and in the length of their handle, and in the distance from the point of the needle body to the skin surface for the safety needle is the same as the distance from the point of the needle body to the upper surface of the second stuffing or to the upper surface of stuffing giving skin puncture like sensation for the placebo needle; and (2) wherein the upper surface of the second stuffing or of the stuffing giving skin puncture like sensation is placed higher than the bottom end of the guide tube by an amount equal to the insertion depth of the safety needle, and the safety needle and the placebo needle can not be distinguished from their appearances.

18. A needle set for double-blind test according to claim 15, wherein:

the safety needle and the placebo needle are the same in their guide tube length, or in the distance from the end of the guide tube to be in contact with the skin to the end of the needle body holding stopper means to be in contact with the needle handle, in the length of the portion protruding from the top end of the guide tube or from the end of the needle body holding stopper means to be in contact with the needle handle, and in the length of their needle handles; and the safety needle and the placebo needle can not be distinguished from their appearances.

19. A needle set for double-blind test according to claim 15, comprising:

(1) a plurality of the safety needles, the safety needles being different from one another in one or more of the following features: the material, length, color and shape of a needle handle; the material, total length and diameter of a needle body; the length of the needle body protruding from the top end of a guide tube or from the needle body holding stopper means; the distance from the point of the needle body to the skin surface; the insertion depth; the material, length, color and shape of the guide tube; and the material, quantity, number and fixation position of a stuffing holding needle body, and (2) a plurality of the placebo needles, the placebo needles being different from one another in one or more of the following features: the material, length, color and shape of the needle handle; the material, total length and diameter of a needle body; the length of the needle body protruding from the top end of the guide tube or from the needle body holding stopper means; the distance from the point of the needle body to the upper surface of a second stuffing or of a stuffing giving skin puncture like sensation; the material, length, color and shape of the guide tube; the material, quantity, number and fixation position of the first stuffing, and the material, quantity, number and fixation position of the second stuffing or of stuffing giving skin puncture like sensation.

20. A needle set for double-blind test according to claim 19, wherein the safety needles are different from each other only in diameter of the needle body, the placebo needles are different from each other only in diameter of the needle body, and the safety needles and the placebo needles are combined, thereby masking the diameters of the needle bodies.

21. A needle set for double-blind test according to claim 14 wherein the placebo needle guide tube has an adhesive or sucking pedestal on the surface of its base to be in contact with the skin.

22. A needle set for double-blind test according to claim 21, (1) wherein the safety needle and the placebo needle are the same in their guide tube lengths, or in the distance from the end of the guide tube to be in contact with the skin to the end of the needle body holding stopper means to be in contact with the needle handles, and in the length of their handle, and in the distance from the point of the needle body to the skin surface for the safety needle is the same as the distance from the point of the needle body to the upper surface of the second stuffing or to the upper surface of stuffing giving skin puncture like sensation for the placebo needle; and (2) wherein the upper surface of the second stuffing or of the stuffing giving skin puncture like sensation is placed higher than the bottom end of the guide tube by an amount equal to the insertion depth of the safety needle, and the safety needle and the placebo needle can not be distinguished from their appearances.

23. A needle set for double-blind test according to claim 21, wherein:

the safety needle and the placebo needle are the same in their guide tube length, or in the distance from the end of the guide tube to be in contact with the skin to the end of the needle body holding stopper means to be in contact with the needle handle, in the length of the portion protruding from the top end of the guide tube or from the end of the needle body holding stopper means to be in contact with the needle handle, and in the length of their needle handles; and the safety needle and the placebo needle can not be distinguished from their appearances.

24. A needle set for double-blind test according to claim 21, comprising:

(1) a plurality of the safety needles, the safety needles being different from one another in one or more of the following features: the material, length, color and shape of a needle handle; the material, total length and diameter of a needle body; the length of the needle body protruding from the top end of a guide tube or from the needle body holding stopper means; the distance from the point of the needle body to the skin surface; the insertion depth; the material, length, color and shape of the guide tube; and the material, quantity, number and fixation position of a stuffing holding needle body, and (2) a plurality of the placebo needles, the placebo needles being different from one another in one or more of the following features: the material, length, color and shape of the needle handle; the material, total length and diameter of a needle body; the length of the needle body protruding from the top end of the guide tube or from the needle body holding stopper means; the distance from the point of the needle body to the upper surface of a second stuffing or of a stuffing giving skin puncture like sensation; the material, length, color and shape of the guide tube; the material, quantity, number and fixation position of the first stuffing, and the material, quantity, number and fixation position of the second stuffing or of stuffing giving skin puncture like sensation.

25. A needle set for double-blind test according to claim 24, wherein the safety needles are different from each other only in diameter of the needle body, the placebo needles are different from each other only in diameter of the needle body, and the safety needles and the placebo needles are combined, thereby masking the diameters of the needle bodies.

26. A needle set for double-blind test according to claim 24, wherein the safety needles are different from each other only in depth of the needle body insertion, the placebo needles are different from each other only in depth of the needle body insertion, and the safety needles and the placebo needles are combined, thereby masking the depths of the needle body insertions.

27. A needle set for double-blind test according to claim 14, (1) wherein the safety needle and the placebo needle are the same in their guide tube lengths, or in the distance from the end of the guide tube to be in contact with the skin to the end of the needle body holding stopper means to be in contact with the needle handles, and in the length of their handle, and in the distance from the point of the needle body to the skin surface for the safety needle is the same as the distance from the point of the needle body to the upper surface of the second stuffing or to the upper surface of stuffing giving skin puncture like sensation for the placebo needle; and (2) wherein the upper surface of the second stuffing or of the stuffing giving skin puncture like sensation is placed higher than the bottom end of the guide tube by an amount equal to the insertion depth of the safety needle, and the safety needle and the placebo needle can not be distinguished from their appearances.

28. A needle set for double-blind test according to claim 14, comprising:

(1) a plurality of the safety needles, the safety needles being different from one another in one or more of the following features: the material, length, color and shape of a needle handle; the material, total length and diameter of a needle body; the length of the needle body protruding from the top end of a guide tube or from the needle body holding stopper means; the distance from the point of the needle body to the skin surface; the insertion depth; the material, length, color and shape of the guide tube; and the material, quantity, number and fixation position of a stuffing holding needle body, and (2) a plurality of the placebo needles, the placebo needles being different from one another in one or more of the following features: the material, length, color and shape of the needle handle; the material, total length and diameter of a needle body; the length of the needle body protruding from the top end of the guide tube or from the needle body holding stopper means; the distance from the point of the needle body to the upper surface of a second stuffing or of a stuffing giving skin puncture like sensation; the material, length, color and shape of the guide tube; the material, quantity, number and fixation position of the first stuffing, and the material, quantity, number and fixation position of the second stuffing or of stuffing giving skin puncture like sensation.

29. A needle set for double-blind test according to claim 28, wherein the safety needles are different from each other only in diameter of the needle body, the placebo needles are different from each other only in diameter of the needle body, and the safety needles and the placebo needles are combined, thereby masking the diameters of the needle bodies.

30. A needle set for double-blind test according to claim 28, wherein the safety needles are different from each other only in depth of the needle body insertion, the placebo needles are different from each other only in depth of the needle body insertion, and the safety needles and the placebo needles are combined, thereby masking the depths of the needle body insertions.

31. A needle set for double-blind test comprising:

(A) a safety needle according to one of a first construction and a second construction wherein:

the first construction comprises:

(1) a guide tube;

(2) one or more stuffings holding needle body which are plugged into the guide tube to be fixed at a desired position, to give resistance to a needle body during its passage therethrough, and to hold the needle body;

(3) the needle body movably held by the stuffing which has the length longer than that of the guide tube by an amount equal to the insertion depth of the needle body; and (4) a stopper which is mounted to the lower end of a needle handle attached to the top of the needle body, or which is mounted to the top end of the guide tube, and prevents the needle handle from advancing further at the moment when the needle point reach a specified insertion depth;

(5) wherein the guide tube is longer than the insertion depth of the needle body; and the second construction comprises:

(1) a guide tube;

(2) a needle body holding stopper means which is mounted outside the top end of the guide tube, and which prevents a needle handle from advancing further into the guide tube when the point of the needle body reaches a specified insertion depth, and not only holds the needle body but gives resistance to it during its passage therethrough; and (3) the needle body movably held by the needle body holding stopper means which has the length longer than the distance from the end of the guide tube in contact with the skin to the end of the needle body holding stopper means to be in contact with the needle handle by an amount equal to the insertion depth of the needle body, (4) wherein the distance from the end of the needle body holding stopper means to be in contact with the needle handle from the end of the guide tube to be in contact with the skin is larger than the insertion depth of the needle body; and (B) a placebo needle comprising (1) a guide tube;

(2) a needle body holding stopper means which is mounted outside the top end of the guide tube, and which prevents the needle handle from advancing further into the guide tube when the point of the needle body reaches just on or above the skin surface, and not only holds the needle body but gives resistance to it during its passage therethrough;

(3) one or more stuffings giving skin puncture like sensation which are plugged into the guide tube to be fixed at a lower position, to give sensations indicative to the skin puncture and the tissue penetration during passage of a needle body through the cavity of the guide tube to reach the specified depth; and (4) the needle body movably held by the needle body holding stopper means which has the length sufficiently long to allow its point to stop just on or above the skin surface when the needle body is advanced through the cavity of the guide tube as far as possible.

32. A needle set for double-blind test according to claim 31 wherein the point of the placebo needle body takes a form impenetrable to a human body.

33. A needle set for double blind test according to claim 31 wherein the placebo needle guide tube has an adhesive or sucking pedestal on the surface of its base to be in contact with the skin.

34. A needle set for double-blind test according to claim 31, (1) wherein the safety needle and the placebo needle are the same in their guide tube lengths, or in the distance from the end of the guide tube to be in contact with the skin to the end of the needle body holding stopper means to be in contact with the needle handles, and in the length of their handle, and in the distance from the point of the needle body to the skin surface for the safety needle is the same as the distance from the point of the needle body to the upper surface of the second stuffing or to the upper surface of stuffing giving skin puncture like sensation for the placebo needle; and (2) wherein the upper surface of the second stuffing or of the stuffing giving skin puncture like sensation is placed higher than the bottom end of the guide tube by an amount equal to the insertion depth of the safety needle, and the safety needle and the placebo needle can not be distinguished from their appearances.

35. A needle set for double-blind test according to claim 31, comprising:

(1) a plurality of the safety needles, the safety needles being different from one another in one or more of the following features: the material, length, color and shape of a needle handle; the material, total length and diameter of a needle body; the length of the needle body protruding from the top end of a guide tube or from the needle body holding stopper means; the distance from the point of the needle body to the skin surface; the insertion depth; the material, length, color and shape of the guide tube; and the material, quantity, number and fixation position of a stuffing holding needle body, and (2) a plurality of the placebo needles, the placebo needles being different from one another in one or more of the following features: the material, length, color and shape of the needle handle; the material, total length and diameter of a needle body; the length of the needle body protruding from the top end of the guide tube or from the needle body holding stopper means; the distance from the point of the needle body to the upper surface of a second stuffing or of a stuffing giving skin puncture like sensation; the material, length, color and shape of the guide tube; the material, quantity, number and fixation position of the first stuffing, and the material, quantity, number and fixation position of the second stuffing or of stuffing giving skin puncture like sensation.

36. A needle set for double-blind test according to claim 35, wherein the safety needles are different from each other only in diameter of the needle body, the placebo needles are different from each other only in diameter of the needle body, and the safety needles and the placebo needles are combined, thereby masking the diameters of the needle bodies.

37. A needle set for double-blind test according to claim 35, wherein the safety needles are different from each other only in depth of the needle body insertion, the placebo needles are different from each other only in depth of the needle body insertion, and the safety needles and the placebo needles are combined, thereby masking the depths of the needle body insertions.

38. A needle set for double-blind test comprising:

(A) a safety needle according to one of a first construction and a second construction wherein:

the first construction comprises:

(1) a guide tube;

(2) one or more stuffings holding needle body which are plugged into the guide tube to be fixed at a desired position, to give resistance to a needle body during its passage therethrough, and to hold the needle body;

(3) the needle body movably held by the stuffing which has the length longer than that of the guide tube by an amount equal to the insertion depth of the needle body; and (4) a stopper which is mounted to the lower end of a needle handle attached to the top of the needle body, or which is mounted to the top end of the guide tube, and prevents the needle handle from advancing further at the moment when the needle point reach a specified insertion depth;

(5) wherein the guide tube is longer than the insertion depth of the needle body; and the second construction comprises:

(1) a guide tube;

(2) a needle body holding stopper means which is mounted outside the top end of the guide tube, and which prevents a needle handle from advancing further into the guide tube when the point of the needle body reaches a specified insertion depth, and not only holds the needle body but gives resistance to it during its passage therethrough; and (3) the needle body movably held by the needle body holding stopper means which has the length longer than the distance from the end of the guide tube in contact with the skin to the end of the needle body holding stopper means to be in contact with the needle handle by an amount equal to the insertion depth of the needle body, (4) wherein the distance from the end of the needle body holding stopper means to be in contact with the needle handle from the end of the guide tube to be in contact with the skin is larger than the insertion depth of the needle body; and (B) a placebo needle comprising (1) a guide tube;

(2) one or more stuffings holding needle body which are plugged into the guide tube to be fixed at a desired position, to give resistance to the needle body during its passage therethrough;

(3) the needle body movably held by the stuffing holding needle body which has the length sufficiently long to allow its point to stop just on or above the skin surface when the needle body being advanced through the cavity of the guide tube as far as possible; and (4) a stopper which is mounted to the lower end of a needle handle attached to the top of the needle body, or which is mounted to the top end of the guide tube, and prevents the needle handle from advancing further into the guide tube when the point of the needle body being advanced through the cavity of the guide tube reaches just on or above the skin.

39. A needle set for double-blind test according to claim 38 wherein the point of the placebo needle body takes a form impenetrable to a human body.

40. A needle set for double blind test according to claim 38 wherein the placebo needle guide tube has an adhesive or sucking pedestal on the surface of its base to be in contact with the skin.

41. A needle set for double-blind test according to claim 38, wherein:

the safety needle and the placebo needle are the same in their guide tube length, or in the distance from the end of the guide tube to be in contact with the skin to the end of the needle body holding stopper means to be in contact with the needle handle, in the length of the portion protruding from the top end of the guide tube or from the end of the needle body holding stopper means to be in contact with the needle handle, and in the length of their needle handles; and the safety needle and the placebo needle can not be distinguished from their appearances.

42. A needle set for double-blind test comprising:

(A) a safety needle according to one of a first construction and a second construction wherein:

the first construction comprises:

(1) a guide tube;

(2) one or more stuffings holding needle body which are plugged into the guide tube to be fixed at a desired position, to give resistance to a needle body during its passage therethrough, and to hold the needle body;

(3) the needle body movably held by the stuffing which has the length longer than that of the guide tube by an amount equal to the insertion depth of the needle body; and (4) a stopper which is mounted to the lower end of a needle handle attached to the top of the needle body, or which is mounted to the top end of the guide tube, and prevents the needle handle from advancing further at the moment when the needle point reach a specified insertion depth;

(5) wherein the guide tube is longer than the insertion depth of the needle body; and the second construction comprises:

(1) a guide tube;

(2) a needle body holding stopper means which is mounted outside the top end of the guide tube, and which prevents a needle handle from advancing further into the guide tube when the point of the needle body reaches a specified insertion depth, and not only holds the needle body but gives resistance to it during its passage therethrough; and (3) the needle body movably held by the needle body holding stopper means which has the length longer than the distance from the end of the guide tube in contact with the skin to the end of the needle body holding stopper means to be in contact with the needle handle by an amount equal to the insertion depth of the needle body, (4) wherein the distance from the end of the needle body holding stopper means to be in contact with the needle handle from the end of the guide tube to be in contact with the skin is larger than the insertion depth of the needle body; and (B) a placebo needle comprising (1) a guide tube;

(2) a needle body holding means which is mounted outside the top end of to the guide,and which prevents a needle handle from advancing further into the guide tube when the point of the body reaches just on or above the skin surface, and not only holds the body but gives resistance to it during its passage therethrough; and (3) the needle body movably held by thee needle body holding stopper means which has the length sufficiently long to allow its point to stop just on or above the skin surface when the needle body is advanced through the cavity of the guide tube as far as possible.

43. A needle set for double-blind test according to claim 42 wherein the point of the placebo needle body takes a form impenetrable to a human body.

44. A needle set for double blind test according to claim 42 wherein the placebo needle guide tube has an adhesive or sucking pedestal on the surface of its base to be in contact with the skin.

45. A needle set for double-blind test according to claim 42, wherein the safety needle and the placebo needle are the same in their guide tube length, or in the distance from the end of the guide tube to be in contact with the skin to the end of the needle body holding stopper means to be in contact with the needle handle, in the length of the portion protruding from the top end of the guide tube or from the end of the needle body holding stopper means to be in contact with the needle handle, and in the length of their needle handles; and the safety needle and the placebo needle can not be distinguished from their appearances.

46. A needle set for double-blind test according to claim 42, comprising:

(1) a plurality of the safety needles, the safety needles being different from one another in one or more of the following features: the material, length, color and shape of a needle handle; the material, total length and diameter of a needle body; the length of the needle body protruding from the top end of a guide tube or from the needle body holding stopper means; the distance from the point of the needle body to the skin surface; the insertion depth; the material, length, color and shape of the guide tube; and the material, quantity, number and fixation position of a stuffing holding needle body, and (2) a plurality of the placebo needles, the placebo needles being different from one another in one or more of the following features: the material, length, color and shape of the needle handle; the material, total length and diameter of a needle body; the length of the needle body protruding from the top end of the guide tube or from the needle body holding stopper means; the distance from the point of the needle body to the upper surface of a second stuffing or of a stuffing giving skin puncture like sensation; the material, length, color and shape of the guide tube; the material, quantity, number and fixation position of the first stuffing, and the material, quantity, number and fixation position of the second stuffing or of stuffing giving skin puncture like sensation.

47. A needle set for double-blind test according to claim 46, wherein the safety needles are different from each other only in diameter of the needle body, the placebo needles are different from each other only in diameter of the needle body, and the safety needles and the placebo needles are combined, thereby masking the diameters of the needle bodies.

48. A needle set for double-blind test according to claim 46, wherein the safety needles are different from each other only in depth of the needle body insertion, the placebo needles are different from each other only in depth of the needle body insertion, and the safety needles and the placebo needles are combined, thereby masking the depths of the needle body insertions.

49. A needle set for double-blind test according to claim 42, comprising:

(1) a plurality of the safety needles, the safety needles being different from one another in one or more of the following features: the material, length, color and shape of a needle handle; the material, total length and diameter of a needle body; the length of the needle body protruding from the top end of a guide tube or from the needle body holding stopper means; the distance from the point of the needle body to the skin surface; the insertion depth; the material, length, color and shape of the guide tube; and the material, quantity, number and fixation position of a stuffing holding needle body, and (2) a plurality of the placebo needles, the placebo needles being different from one another in one or more of the following features: the material, length, color and shape of the needle handle; the material, total length and diameter of a needle body; the length of the needle body protruding from the top end of the guide tube or from the needle body holding stopper means; the distance from the point of the needle body to the upper surface of a second stuffing or of a stuffing giving skin puncture like sensation; the material, length, color and shape of the guide tube; the material, quantity, number and fixation position of the first stuffing, and the material, quantity, number and fixation position of the second stuffing or of stuffing giving skin puncture like sensation.

50. A needle set for double-blind test according to claim 49, wherein the safety needles are different from each other only in diameter of the needle body, the placebo needles are different from each other only in diameter of the needle body, and the safety needles and the placebo needles are combined, thereby masking the diameters of the needle bodies.

51. A needle set for double-blind test according to claim 49, wherein the safety needles are different from each other only in depth of the needle body insertion, the placebo needles are different from each other only in depth of the needle body insertion, and the safety needles and the placebo needles are combined, thereby masking the depths of the needle body insertions.

52. A needle set for double-blind test according to claim 49, wherein the safety needles are different from each other only in depth of the needle body insertion, the placebo needles are different from each other only in depth of the needle body insertion, and the safety needles and the placebo needles are combined, thereby masking the depths of the needle body insertions.

* * * * *